US009810011B2

(12) United States Patent
Matsuo

(10) Patent No.: US 9,810,011 B2
(45) Date of Patent: Nov. 7, 2017

(54) OPENING/CLOSING DEVICE

(71) Applicant: BUNKA SHUTTER CO., LTD., Tokyo (JP)

(72) Inventor: Kazunori Matsuo, Saitama (JP)

(73) Assignee: BUNKA SHUTTER CO., LTD., Tokyo (JP)

( * ) Notice: Subject to any disclaimer, the term of this patent is extended or adjusted under 35 U.S.C. 154(b) by 0 days.

(21) Appl. No.: 14/648,828

(22) PCT Filed: Nov. 6, 2013

(86) PCT No.: PCT/JP2013/079974
§ 371 (c)(1),
(2) Date: Jun. 1, 2015

(87) PCT Pub. No.: WO2014/087782
PCT Pub. Date: Jun. 12, 2014

(65) Prior Publication Data

US 2015/0322703 A1 Nov. 12, 2015

(30) Foreign Application Priority Data

Dec. 4, 2012 (JP) ..... 2012-265796
Dec. 4, 2012 (JP) ..... 2012-265797

(51) Int. Cl.
*E05B 65/00* (2006.01)
*E05D 15/38* (2006.01)
(Continued)

(52) U.S. Cl.
CPC ..... *E05D 15/38* (2013.01); *E05B 65/0021* (2013.01); *E05D 13/006* (2013.01);
(Continued)

(58) Field of Classification Search
CPC . E05D 13/003; E05D 13/006; E05D 13/1238; E05D 13/1292; E05D 15/165;
(Continued)

(56) References Cited

U.S. PATENT DOCUMENTS 2,124,970 A * 7/1938 Bagley ..... E05B 65/0021 114/201 R
2,309,437 A * 1/1943 Blodgett ..... E05B 65/0021 160/201
(Continued)

FOREIGN PATENT DOCUMENTS

JP 55-24310 6/1980
JP 63-174277 11/1988
(Continued)

OTHER PUBLICATIONS

International Search Report for PCT/JP2013/079974 dated Feb. 10, 2014.
(Continued)

*Primary Examiner* — Katherine Mitchell
*Assistant Examiner* — Abe Massad
(74) *Attorney, Agent, or Firm* — Greenblum & Bernstein, P.L.C.

(57) ABSTRACT

Provided is an opening/closing device that includes a structure for inhibiting a brake engage part or a lock engage part from touching an object or the like and that prevent the perimeter of a guide rail from becoming thick due to the structure.
In an opening/closing device in which a brake engage part is caused to engage with a first engaged part by a close prevention device to put a brake on the closing operation of an opening/closing body, a space adjacent to the horizontal width direction end face of the opening/closing body and continuous in the opening/closing body opening/closing
(Continued)

direction is ensured, the space is encompassed in the opening/closing body opening/closing direction by the horizontal width direction end face of the opening/closing body, the guide rail, and the support member, and a detach spot for the first engaged part and the brake engage part is arranged within the space.

9 Claims, 17 Drawing Sheets

(51) Int. Cl.
*E05D 13/00* (2006.01)
*E06B 3/48* (2006.01)
*E06B 1/52* (2006.01)
*E05D 15/16* (2006.01)

(52) U.S. Cl.
CPC ..... *E05D 13/1238* (2013.01); *E05D 13/1292* (2013.01); *E06B 1/522* (2013.01); *E06B 3/48* (2013.01); *E05D 15/165* (2013.01); *E05Y 2800/41* (2013.01); *E06B 3/485* (2013.01)

(58) Field of Classification Search
CPC ..... E05D 15/38; E05B 65/0021; E06B 1/522; E06B 3/48; E06B 3/485
See application file for complete search history.

(56) References Cited

U.S. PATENT DOCUMENTS 2,703,247 A * 3/1955 Wolf ..... E05B 65/0021 160/191
2,869,183 A * 1/1959 Smith ..... E05D 13/006 188/67
3,276,165 A * 10/1966 Purcell ..... B66B 13/06 49/322
5,601,131 A * 2/1997 Morris ..... E05B 65/0021 160/207
5,698,073 A * 12/1997 Vincenzi ..... E05B 65/0021 160/188
6,042,158 A * 3/2000 Horn ..... E05D 13/006 16/DIG. 20
6,189,266 B1 * 2/2001 Mihalcheon ..... E05D 13/006 160/201
7,114,753 B2 * 10/2006 Nodorft ..... E05B 47/0002 160/201
7,484,332 B2 * 2/2009 Hormann ..... E05D 13/006 160/201
8,528,256 B2 * 9/2013 Haba ..... E05D 13/006 49/322
2008/0023603 A1 * 1/2008 Michaud ..... E05D 13/006 248/222.51
2012/0186158 A1 * 7/2012 Sanke ..... E05D 13/006 49/322

FOREIGN PATENT DOCUMENTS

| | | |
|---|---|---|
| JP | 4-14617 | 4/1992 |
| JP | 7-43429 | 10/1995 |
| JP | 2502746 | 6/1996 |
| JP | 9-303060 | 11/1997 |
| JP | 2001-20644 | 1/2001 |
| JP | 2005-107927 | 4/2005 |
| JP | 2005-226292 | 8/2005 |
| JP | 2007-211411 | 8/2007 |
| JP | 2007-218031 | 8/2007 |

OTHER PUBLICATIONS

Official Action, along with English-language translation thereof, in JP Appl. No. 2012-265796 dated Nov. 22, 2016.
Official Action, along with English-language translation thereof, in JP Appl. No. 2012-265797 dated Nov. 22, 2016.
Extended European Search Report for EP Appl. No. 13859930.3 dated Aug. 24, 2016.
Official Action, along with English-language translation thereof, issued in JP Appl. No. 2012-265796 dated Jun. 6, 2017.
Official Action, along with English-language translation thereof, issued in JP Appl. No. 2012-265797 dated Jun. 6, 2017.

* cited by examiner

OPENING/CLOSING DEVICE

TECHNICAL FIELD

The present invention relates to an opening/closing device equipped with a close prevention device to prevent a sudden closing operation of an opening/closing body, and particularly relates to an opening/closing device suitable as an overhead door.

BACKGROUND ART

Conventionally, as this type of invention, there is an opening/closing device including an opening/closing body (10) that performs an opening/closing operation in a vertical direction, a roller member (12) protruding in a horizontal width direction from the opening/closing body and supported to be rotatable by the opening/closing body, a guide rail (20) that holds the roller member to be rollable and is continuous in the vertical direction, a close prevention device (40) provided integrally with the opening/closing body and configured to detach a movable engage member (42) from the guide rail, urging member (43: torsion coil spring) for urging the movable engage member in a seizing direction, and a traction member (33: wire or the like) that pulls the movable member upward and apart from the guide rail against the urging force of the urging member, as described in Patent Literature 1.

If in any case the traction member (33) is cut or comes off, a mechanism that winds the traction member is damaged and spins idly, or the like such that the tension of the traction member decreases, the opening/closing device can prevent the opening/closing device (10) from falling, by causing the movable engage member (42) to pivot with the urging force of the urging member (43) and causing a brake engage part (42*c*: blade) of the movable member to bite into the guide rail (20).

Since the structure in the conventional technique described above is such that the brake engage part (42*c*) with a sharp tip end part is moved in an exposed state, it is desirable that an alteration be made lest an object or the like be sandwiched between the brake engage part (42*c*) and the guide rail (20), an object or the like touch the tip end part of the brake engage part (42*c*), or the like.

Thus, for example, in the invention described in Patent Literature 2, the brake engage part (42*c*: blade) and the whole moving path of the brake engage part (42*c*: blade) are covered by a cover member (50) from the interior side of the opening/closing body (10).

However, in the invention described in Patent Literature 2, the entire perimeter of the guide rail may become thick due to the cover member (50) or the cover member (50) protruding to the interior side.

As a different conventional technique, there is an opening/closing device including an opening/closing body (overhead door 1) that performs an opening/closing operation in a vertical direction, a roller member (rolling roller) protruding in a horizontal width direction from the opening/closing body and supported to be rotatable by the opening/closing body, a guide rail (2) that holds the roller member to be rollable and is continuous in the vertical direction, an engaged part (engage member 9) fixed to the guide rail, and a lock mechanism (8) provided integrally with the opening/closing body and configured to detach a lock engage part (seize member 10) from the engaged part, as described in Patent Literature 3.

However, since the lock engage part (seize member 10) performs a detaching operation with respect to the engaged part (engage member 9) in a position protruding to the interior side from the face of the opening/closing body in this conventional technique, there is a risk of an object or the like being sandwiched between the lock engage part and the engaged part, an object or the like touching the lock engage part, or the like.

RELATED ART LITERATURE

Patent Literature

[Patent Literature 1] Japanese Patent Application Laid-open No. 2007-211411

[Patent Literature 2] Japanese Patent Application Laid-open No. 2007-218031

[Patent Literature 3] Japanese Patent Application Laid-open No. 2005-107927

SUMMARY OF THE INVENTION

Technical Problem

The present invention has been made in view of the conventional circumstances described above. A task is to provide an opening/closing device that includes a structure for inhibiting a brake engage part or a lock engage part from touching an object or the like and that can prevent the perimeter of a guide rail from becoming thick due the structure.

Solution to Problem

One solution is an opening/closing device including: an opening/closing body that performs a closing operation as a partition; a roller member that protrudes in an opening/closing body horizontal width direction from the opening/closing body and supported to be rotatable by the opening/closing body; a guide rail that guides the roller member in an opening/closing body opening/closing direction; a support member that supports the guide rail in the opening/closing body opening/closing direction; an engaged part that is fixed to an unmovable portion; and a close prevention device that is provided integrally with the opening/closing body and configured to detach a brake engage part from the engaged part, the brake engage part being caused to engage with the engaged part by the close prevention device to put a brake on the closing operation of the opening/closing body, the opening/closing device being characterized in that a space adjacent to a horizontal width direction end face of the opening/closing body and continuous in the opening/closing body opening/closing direction is formed, the space is encompassed in the opening/closing body opening/closing direction by the horizontal width direction end face of the opening/closing body, the guide rail, and the support member, and a detach spot for the engaged part and the brake engage part is arranged in the space.

Advantageous Effects of Invention

Since the present invention is configured in a manner described above, a structure for inhibiting the brake engage part or the lock engage part from touching an object or the like is included, and the perimeter of the guide rail can be prevented from becoming thick due to the structure.

DESCRIPTION OF EMBODIMENTS

Figure 1:
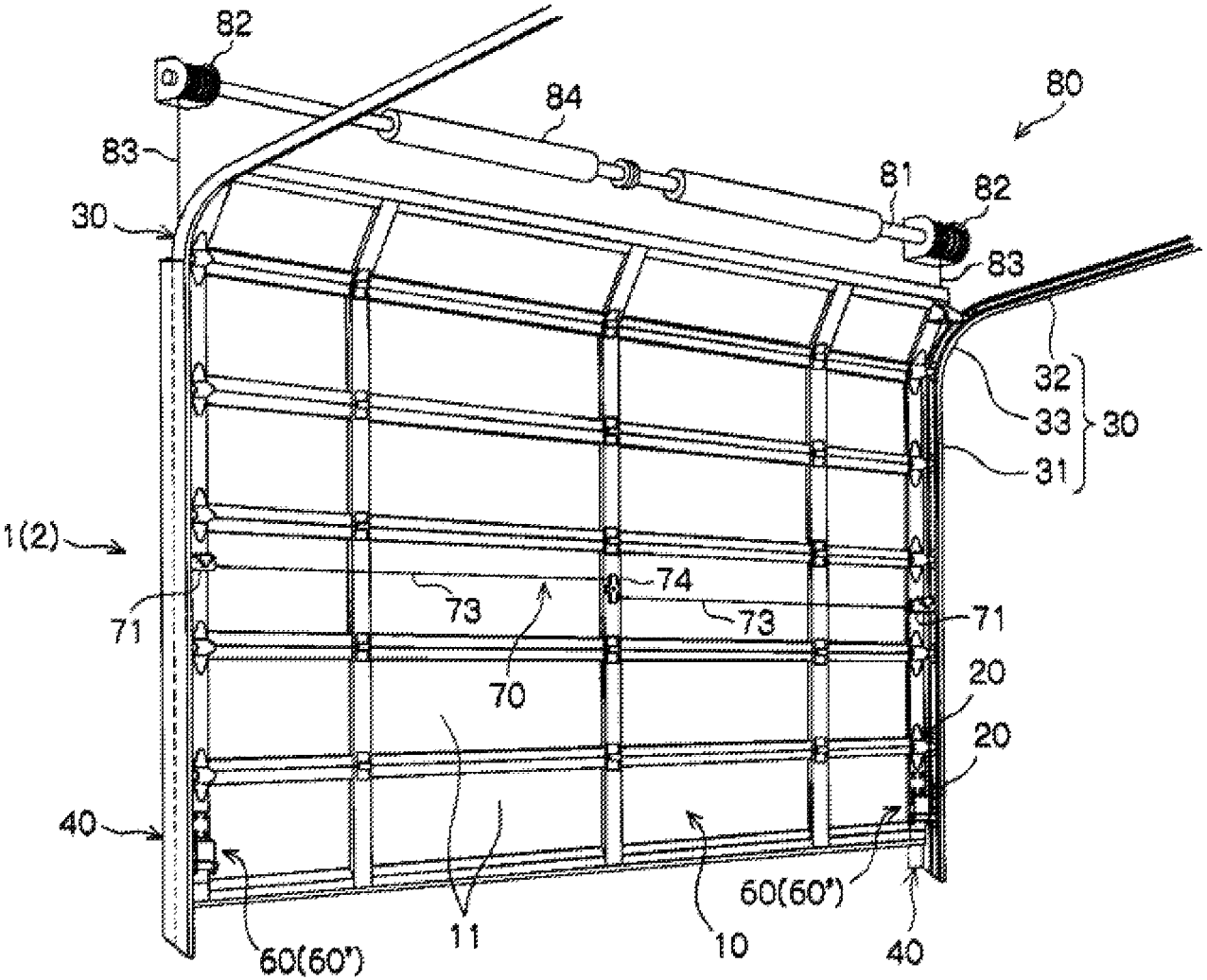
FIG. 1 is a perspective view showing one example of an opening/closing device of this embodiment.
Figure 2:
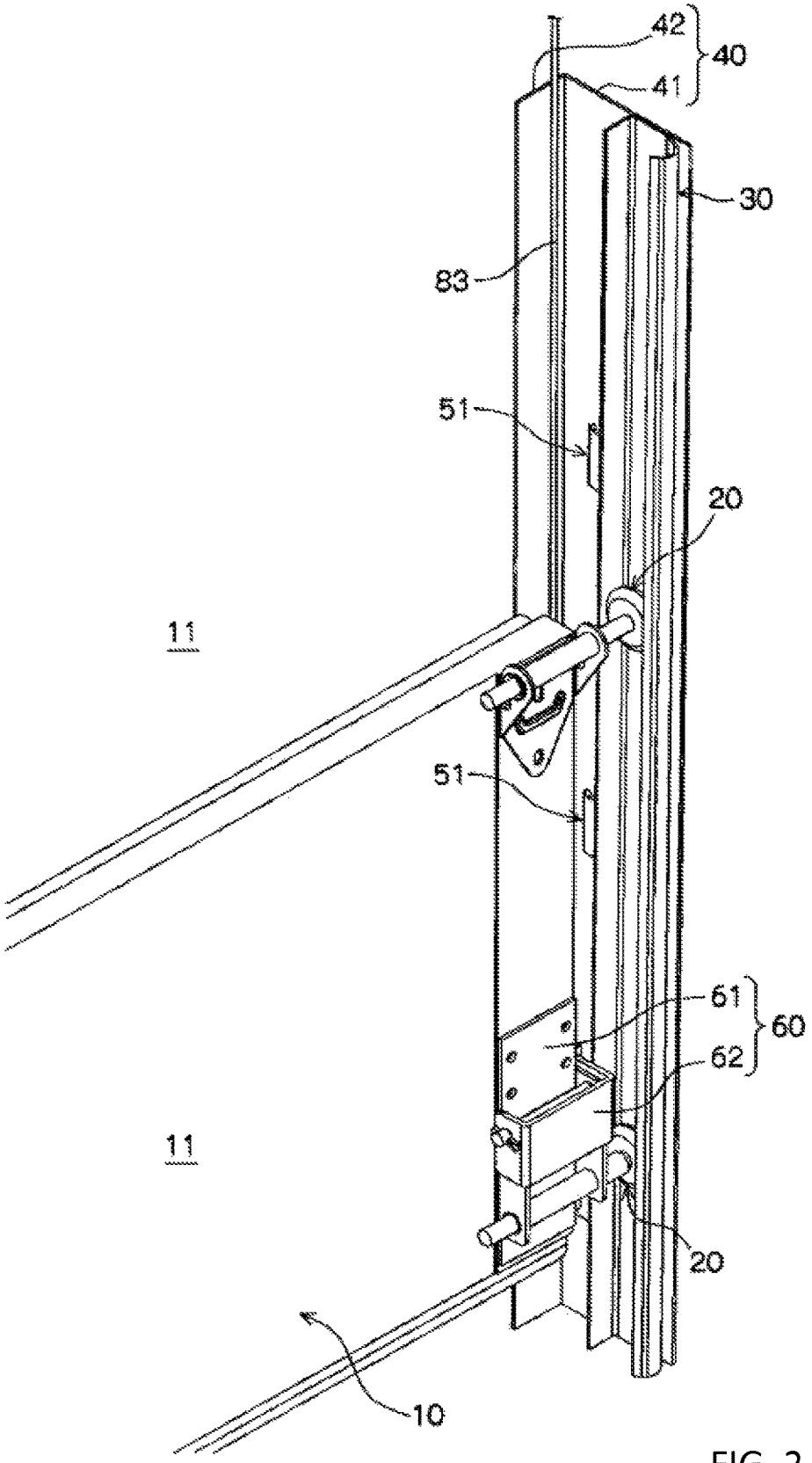
FIG. 2 is a perspective view of a main part of the same opening/closing device.

A first feature of this embodiment is that, in an opening/closing device including: an opening/closing body that performs a closing operation as a partition; a roller member that protrudes in an opening/closing body horizontal width direction from the opening/closing body and supported to be rotatable by the opening/closing body; a guide rail that guides the roller member in an opening/closing body opening/closing direction; a support member that supports the guide rail in the opening/closing body opening/closing direction; an engaged part that is fixed to an unmovable portion; and a close prevention device that is provided integrally with the opening/closing body and configured to detach a brake engage part from the engaged part, the brake engage part being caused to engage with the engaged part by the close prevention device to put a brake on the closing operation of the opening/closing body, the opening/closing device being characterized in that a space adjacent to a horizontal width direction end face of the opening/closing body and continuous in the opening/closing body opening/closing direction is formed, the space is encompassed in the opening/closing body opening/closing direction by the horizontal width direction end face of the opening/closing body, the guide rail, and the support member, and a detach spot for the engaged part and the brake engage part is arranged in the space.

According to this feature, the space adjacent to the horizontal width direction end face of the opening/closing body is encompassed by the horizontal width direction end face of the opening/closing body, the guide rail, and the support member, and the engaged part and the brake engage part are arranged in the space. Therefore, an object or the like being sandwiched between the engaged part and the brake engage part or the brake engage part touching an object or the like can be inhibited. Moreover, the perimeter of the guide rail can be made relatively thin without a cover member or the like protruding to the opening/closing body thickness direction side of the guide rail.

In addition to the first feature described above, a second feature is characterized in that the support member is formed to have an L-shaped sectional surface formed of a support piece that opposes the horizontal width direction end face of the opening/closing body and supports and fixes the guide rail at one end side in an opening/closing body thickness direction and a cover piece that protrudes to a side of the opening/closing body from the other end side in the opening/closing body thickness direction of the support piece, and the detach spot for the engaged part and the brake engage part is encompassed by the horizontal width direction end face of the opening/closing body, the guide rail, the support piece, and the cover piece.

According to this feature, the detach spot for the brake engage part and the engaged part can be covered with a more specific and simple configuration.

In addition to the first feature or the second feature described above, a third feature is characterized in that the engaged part is provided to protrude to a side of the space from the guide rail or the support member, and the brake engage part is provided to move, within the space, between a position in which contact with the engaged part from an opening/closing body opening direction side is possible and a position in which contact with this engaged part from the opening/closing body opening direction side is impossible.

According to this feature, the brake engage part and the engaged part can be caused to contact to more effectively put a brake on the closing operation of the opening/closing body.

In addition to the third feature described above, a fourth feature is that at least one of the engaged part and the brake engage part is formed to come over and engage, in a hook shape, with the other one of the engaged part and the brake engage part.

According to this feature, bouncing of the brake engage part due to reaction upon contact with the engaged part such that an engaged state is not ensured can be reduced.

In addition to any one of the first to fourth features described above, a fifth feature is characterized in that the close prevention device includes a fix member fixed on a side of the opening/closing body and a movable member supported by the fix member and integrally including the brake engage part, and the movable member is provided to be pivotable between an engage possible position in which engagement of the brake engage part with the engaged part is possible and an engage impossible position in which engagement of the brake engage part with the engaged part is impossible, the movable member being maintained in the engage impossible position by being pulled by a traction member from the opening/closing body opening direction side and being provided to pivot to a side of the engage possible position by the movable member's own weight, upon loss of tension of the traction member.

According to this feature, the movable member can be caused to pivot with its own weight upon loss of the tension of the traction member, such that the brake engage part engages with the engaged part.

As a preferable specific example, the traction member is provided to pull the movable member obliquely from one side in the opening/closing body thickness direction, and the movable member is provided to pivot to the other side from the one side with its own weight upon loss of the tension of the traction member (see FIG. 7 to FIG. 10).

As a different preferable specific example, the traction member is provided to pull the movable member obliquely from one side in the opening/closing body thickness direction, and the movable member is provided to pivot to the one side from the other side, with respect to the one side, with its own weight upon loss of the tension of the traction member (see FIG. 15 to FIG. 21).

In addition to any one of the first to fifth features described above, a sixth feature is that airtight unit for inhibiting connection of the space and an outer space is provided between the opening/closing body and the support member.

According to this feature, the airtightness within and without the opening/closing body can obviously be improved by the airtight unit, and an object or the like being inserted between the opening/closing body and the support member such that the object or the like touches the brake engage part or the engaged part can be prevented.

In addition to any one of the first to sixth features described above, a seventh feature is that the detach spot for the engaged part and the brake engage part is arranged in the space corresponding to a thickness of the opening/closing body.

According to this feature, an object or the like touching the brake engage part can be prevented more effectively, and the perimeter of the guide rail can be made thinner.

In addition to any one of the first to seventh features described above, an eighth feature is that, in the opening/closing device, the engaged part is a first engaged part, a second engaged part fixed to an unmovable portion and a lock mechanism provided integrally with the opening/closing body and configured to detach a lock engage part from the second engaged part are included, and the lock engage part is caused to engage with the second engaged part by the lock mechanism to lock the opening/closing body so that the opening/closing body does not move in an opening direction and/or a closing direction, the opening/closing device being further characterized in that a detach spot for the second engaged part and the lock engage part is arranged in the space.

According to this feature, an object or the like being sandwiched between the lock engage part and the second engaged part or an object or the like touching the lock engage part can be inhibited. Moreover, members or the like protruding in the opening/closing body thickness direction can be reduced, since the detach spot for the lock engage part and the second engaged part is arranged in the space adjacent to the horizontal width direction end face of the opening/closing body.

In addition to the eight feature described above, a ninth feature is that the first engaged part and the second engaged part are a common portion, and both of the movable engage part and the lock engage part detach from the portion.

According to this feature, the first engaged part and the second engaged part can be made common to improve the productivity of the opening/closing device.

In addition to the eighth or ninth feature described above, a tenth feature is that the detach spot for the second engaged part and the lock engage part is arranged in the space corresponding to a thickness of the opening/closing body.

In addition to any one of the eighth to tenth features described above, an eleventh feature is that the lock engage part is supported to be rotatable by a face of the opening/closing body, and a free end side part is caused to pivot within the space thereby detaching from the second engaged part.

In addition to the eleventh feature described above, a twelfth feature is that the lock engage part includes a first piece that is in the opening/closing body horizontal width direction along the face of the opening/closing body, a second piece that is connected to the first piece and that is in the opening/closing body thickness direction along a width direction end face of the opening/closing body, and a third piece that is connected to the second piece and extends in the opening/closing body horizontal width direction, and a part on a side of the third piece is caused to pivot along the opening/closing body thickness direction thereby detaching in a protrusion/depression shape from the second engaged part.

In addition to any one of the eighth to twelfth features, a thirteenth feature is that the opening/closing device further includes a store rail part that extends in the intersecting direction intersecting with an opening direction side of the guide rail such that the opening/closing body after being opened linearly in an opening direction is stored in the intersecting direction with respect to the opening direction, and characterized in that the second engaged part is provided at the store rail part to lock the opening/closing body in an opened state such that closing is impossible.

This embodiment also discloses an independent invention in which a part of the feature described above is not included as a component. That is, one of the inventions is an opening/closing device including an opening/closing body that performs a closing operation as a partition, a roller member that protrudes in an opening/closing body horizontal width direction from the opening/closing body and supported to be rotatable by the opening/closing body, a guide rail that guides the roller member in an opening/closing body opening/closing direction, a support member that supports the guide rail in the opening/closing body opening/closing direction, an engaged part fixed to an unmovable portion, and a lock mechanism provided integrally with the opening/closing body and configured to detach a lock engage part from the engaged part, the lock engage part being caused to engage with the engaged part by the lock mechanism to lock the opening/closing body to not move in an opening direction and/or a closing direction, characterized in that a space adjacent to a horizontal width direction end face of the opening/closing body and continuous in the opening/closing body opening/closing direction is ensured, the space is encompassed in the opening/closing body opening/closing direction by the horizontal width direction end face of the opening/closing body, the guide rail, and the support member, and a detach spot for the engaged part and the lock engage part is arranged in the space.

According to this invention, the space adjacent to the horizontal width direction end face of the opening/closing body is encompassed by the horizontal width direction end face of the opening/closing body, the guide rail, and the support member, and the engaged part and the lock engage part are arranged in the space. Therefore, an object or the like being sandwiched between the engaged part and the lock engage part or the lock engage part touching an object or the like can be inhibited. Moreover, members or the like protruding to the opening/closing body thickness direction side of the guide rail can be reduced, thus enabling the perimeter of the guide rail to be made relatively thin.

In this description, "opening/closing body opening/closing direction" means a direction in which the opening/closing body slides in order to partition a space or open at an opening part to be opened/closed by the opening/closing device. In this description, "opening/closing body thickness direction" means the thickness direction of the opening/closing body in the fully closed state. In this description, "opening/closing body width direction" or "opening/closing body horizontal width direction" means a direction approximately orthogonal to the opening/closing body opening/closing direction, the direction being not in the thickness direction of the opening/closing body.

Embodiment

Next, a preferred embodiment including the feature described above will be described in detail based on the drawings.

An opening/closing device 1 of this embodiment will be described as one example of application to an overhead door in which an opening/closing body 10 is caused to slide and opened to the opening direction side (upper side according to the example shown in the drawing) and the opening/closing body 10 is further caused to slide in a direction (obliquely upward according to the example shown in the drawing) intersecting with the opening direction to be stored.

As shown in FIG. 1 to FIG. 13, the opening/closing device 1 includes the opening/closing body 10 that performs a closing operation downward as a partition, a roller member 20 protruding in the opening/closing body horizontal width direction from the opening/closing body 10 and supported to be rotatable by the opening/closing body 10, a guide rail 30 with which the roller member 20 is held (see FIG. 3) from one side in the opening/closing body thickness direction to be rollable and guided in the opening/closing direction, a support member 40 that supports the guide rail 30 continuously in the opening/closing body opening/closing direction, a first engaged part 51 (see FIG. 3) and a second engaged part 52 (see FIG. 11) fixed to an unmovable portion (the support member 40 according to the example shown in the drawing), a close prevention device 60 provided integrally with the opening/closing body 10 and configured to detach a brake engage part 62*b* from the first engaged part 51, a lock mechanism 70 provided integrally with the opening/closing body 10 and configured to detach a lock engage part 71 from the second engaged part 52, and a traction mechanism 80 that pulls the opening/closing body 10 from the opening/closing body opening direction side via the close prevention device 60.

In the case where the tension of the traction mechanism 80 is lost and the opening/closing body 10 has suddenly closed due to a failure or the like in the traction mechanism 80, the opening/closing device 1 causes the brake engage part 62*b* of the close prevention device 60 to engage with the first engaged part 51 and put a brake on the closing operation of the opening/closing body 10.

When the opening/closing body 10 is in a predetermined position (fully opened position and fully closed position according to one example of this embodiment), the opening/closing device 1 causes the lock engage part 71 of the lock mechanism 70 to engage with the second engaged part 52 to lock the opening/closing body 10 to not move in the opening direction and/or the closing direction.

The opening/closing device 1 ensures a space S (see FIG. 3) adjacent to the width direction end face of the opening/closing body 10 and continuous in the opening/closing body opening/closing direction, the space S corresponding to a thickness t of the opening/closing body 10. The space S is encompassed continuously in the opening/closing body opening/closing direction by the horizontal width direction end face of the opening/closing body 10, the guide rail 30, and the support member 40. In the space S, a detach spot for the first engaged part 51 and the brake engage part 62*b* is arranged (see FIG. 3). Further, in the same space S, an engage spot for the second engaged part 52 and the lock engage part 71 is also arranged (see FIG. 12).

The opening/closing body 10 is formed of a plurality of approximately rectangular panel-shaped members 11 that is long in the horizontal width direction being connected in the opening/closing direction to pivot between adjacent panel-shaped members 11.

The opening/closing body 10 performs an opening/closing operation along the guide rail 30 via the roller member 12 supported at each of both end parts in the horizontal width direction.

A plurality of the roller member 20 are arranged at predetermined intervals in the opening/closing body opening/closing direction and supported to freely rotate on the end part side in the horizontal width direction of the opening/closing body 10.

Among the plurality of roller members 20 aligned in the opening/closing body opening/closing direction, the lowermost roller member 20 is supported to freely rotate by the close prevention device 60 described later.

Each roller member 20 is formed such that an approximately donut-shaped roll body 22 is supported on the tip end side of a shaft part 21 that is in the opening/closing body horizontal width direction. According to the example shown in the drawing, the roller member 20 is configured such that the shaft part 21 and the roll body 22 rotate integrally. However, as a different example, a form is also possible in which the roll body 22 is supported to be rotatable with respect to the shaft part 21.

Figure 3:
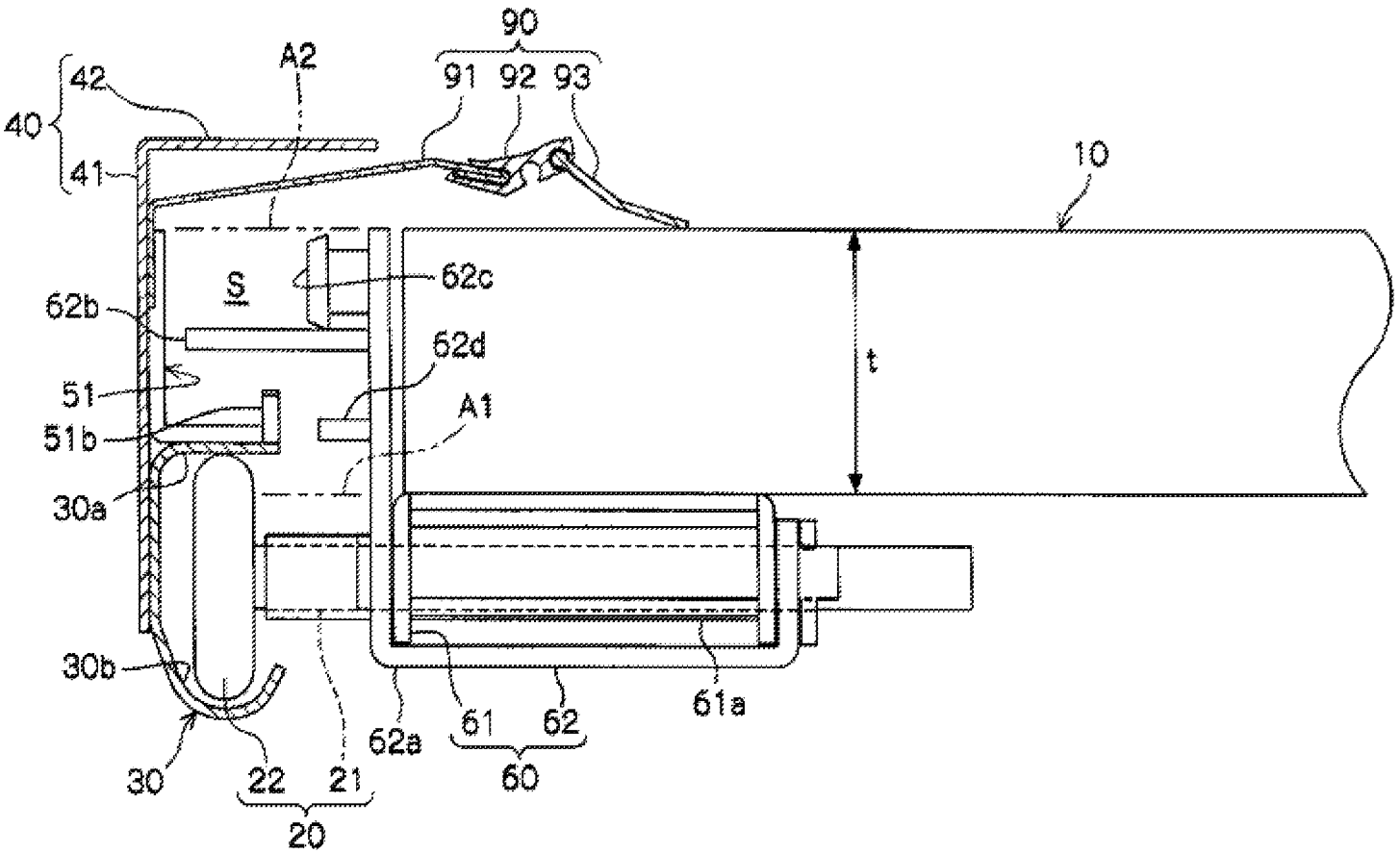
FIG. 3 is a sectional view of a main part of the same opening/closing device.
Figure 4:
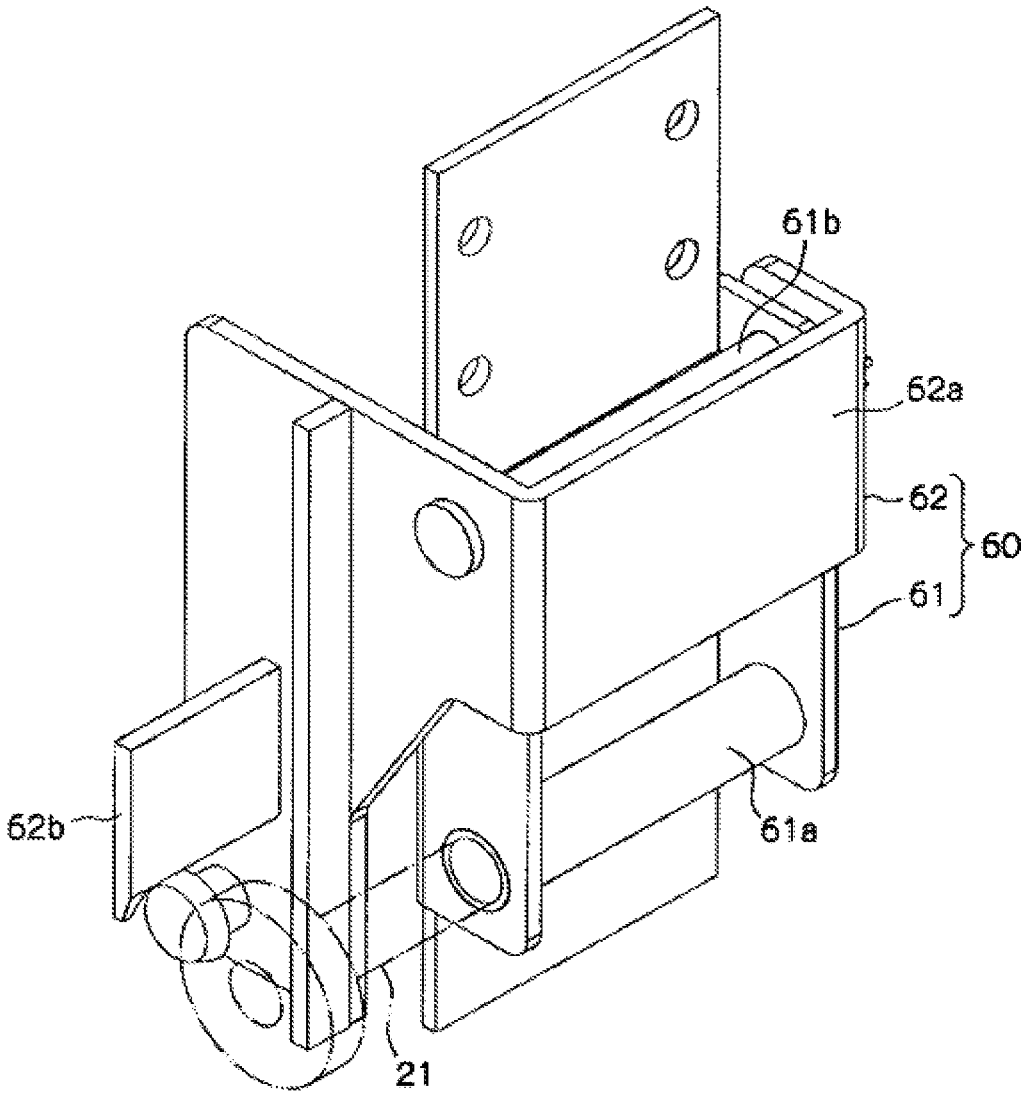
FIG. 4 is a perspective view showing one example of a close prevention device.

According to FIG. 3 and FIG. 4, the roller member 20 is supported by the close prevention device 60. However, provision to a part other than the close prevention device 60 in the opening/closing body 10 as with the roller member 20 on the upper side shown in FIG. 2 or provision to a part other than the example shown in the drawing is possible.

The guide rail 30 is configured integrally of an opening/closing rail part 31 that is in the opening/closing direction of the opening/closing body 10, a store rail part 32 that stores the opening/closing body 10 in a direction (obliquely upward direction according to the example shown in the drawing) intersecting with the opening/closing direction upon opening, and a corner rail part 33 that connects the opening/closing rail part 31 and the store rail part 32 in a smooth curved shape. The rail parts 31, 33, and 32 are formed with an approximately U-shaped sectional surface (see FIG. 3) that covers the roll body 22 of the roller member 20 to be pivotable in the running direction.

The face on the outdoor side (upper side in FIG. 3) in the opening/closing body thickness direction on the inside of the guide rail 30 is a flat-shaped holding face 30*a* that holds the roll body 22 of the roller member 20 to be rollable. The face on the indoor side (lower side in FIG. 3) in the opening/closing body thickness direction on the inside of the same guide rail 30 is a depressed curve part 30*b* that covers the outer circumference side of the roll body 22 with a sectional shape approximately of a depressed curve to prevent falling of the roll body 22.

The guide rail 30 is fixed to and supported by the support member 40 described later by fixing method such as welding.

The indoor side and the outdoor side are expressions for the sake of convenience in giving an easier description. The indoor side means the side in the opening/closing body thickness direction on which the close prevention device 60 is fixed to the opening/closing body 10. The outdoor side means the opposite side of the indoor side in the opening/closing body thickness direction. Obviously, the position of providing the close prevention device 60 is not limited to the indoor side. The close prevention device 60 may naturally be arranged on the outside of a room or house, depending on the purpose of use or the like of the opening/closing device 1. Further, instead of being provided in a room or house, the close prevention device 60 may be provided in a spot where the concept of a room or the like is absent, as a mere partition of a path or an alternative to a gate or the like in outer space, for example.

The support member 40 is a member to be immovably fixed with respect to a building structure, support column, or the like to which the opening/closing device 1 is to be installed, and supports the guide rail 30 continuously in the opening/closing body opening/closing direction.

The support member 40 is formed with an L-shaped sectional face formed of a flat-shaped support piece 41 that supports and fixes the guide rail 30 at one end side in the opening/closing body thickness direction opposing the horizontal width direction end face of the opening/closing body 10 and a flat-shaped cover piece 42 that protrudes to the opening/closing body 10 side (right direction side according to FIG. 3) from the other end side in the opening/closing body thickness direction in the support piece 41.

Between the support member 40 and the opening/closing body 10, airtight unit 90 is provided.

The airtight unit 90 is such that the base end side is fixed to the support member 40, and a free end part is caused to touch the surface on the outdoor side of the opening/closing body 10 to inhibit communication of the space S within the support member 40 and outer space.

To illustrate in more detail, the airtight unit 90 is configured of a metal fix piece 91 with an approximately L-shaped sectional surface that is attached and fixed to the support member 40, a connecting member 92 formed of synthetic resin that is fitted and fixed to the protruding end side in the opening/closing body width direction of the fix piece 91, and an elastic airtight member 93 formed of synthetic resin that is supported by the connecting member 92. The fix piece 91, the connecting member 92, and the elastic airtight member 93 communicate in the opening/closing body opening/closing direction.

With the airtight unit 90, the elastic airtight member 93 is pushed against the opening/closing body 10 by the elastic force in the flexing direction of the fix piece 91, the elastic airtight member 93 elastically deforms, and the area touching the face of the opening/closing body 10 increases.

Thus, the airtightness between the end part in the horizontal width direction of the opening/closing body 10 and the support member 40 can be improved.

Moreover, since a gap between the support member 40 and the opening/closing body 10 is covered, an object or the like being inserted to the space S from the gap can be inhibited.

The space S is a space continuous in the opening/closing body opening/closing direction that is encompassed in four directions by the end part in the horizontal width direction of the opening/closing body 10, a part including the holding face 30*a* of the guide rail 30, and the support member 40. The space S is adjacent to the end face in the horizontal width direction of the opening/closing body 10 and provided in a range corresponding to the thickness t of the opening/closing body 10. More specifically, the space S is ensured between two virtual planes A1 and A2 that are extensions of the face on the outdoor side and the face on the indoor side of the opening/closing body 10 to the support member 40 side.

Figure 5:
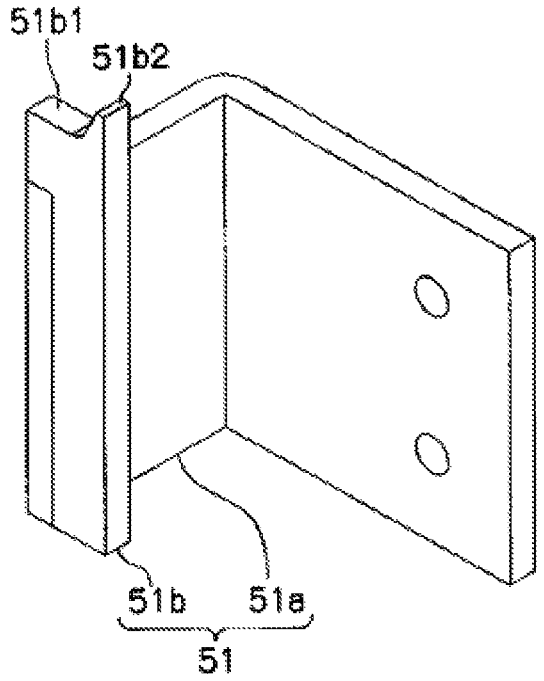
FIG. 5 is a perspective view showing one example of an engaged part.
Figure 6:
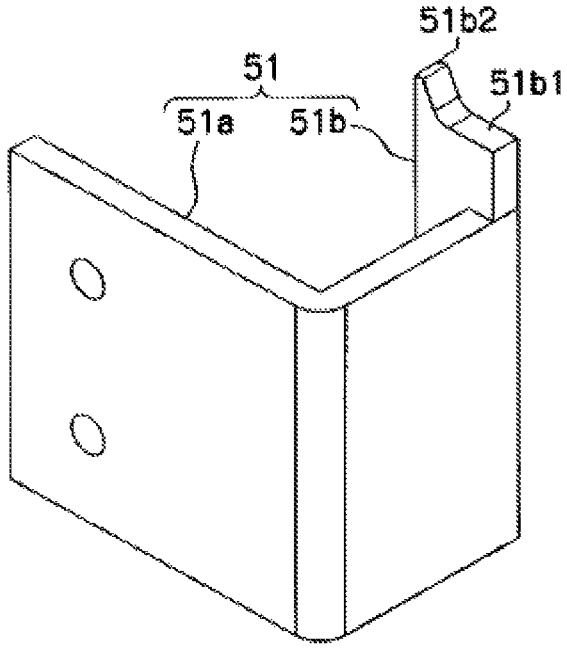
FIG. 6 is a perspective view showing the same engaged part from a different viewpoint.

The first engaged part 51 is a portion to be detached by the brake engage part 62*b*. To illustrate in detail, as shown in FIG. 5 and FIG. 6, included are a fix piece 51*a* with an L-shaped angle that is fixed to the inner face of the support member 40 and a protruding piece 51*b* connected to the fix piece 51*a* and provided to protrude to the opening/closing body opening direction side relative to the fix piece 51*a*, thus forming an approximately U-shape in planar view according to the example shown in the drawing.

A plurality of the first engaged parts 51 are provided with intervals in the vertical direction, and each is fixed to the support piece 41.

A method for attaching the fix piece 51*a* with respect to the support member 40 is rivet tightening or thread tightening according to the example shown in the drawing. However, other attaching method such as welding or fitting is also possible. It suffices that the fix piece 51*a* be fixed to an unmovable portion. As a different example, the fix piece 51*a* may be fixed to the guide rail 30 or a different unmovable member that is not shown.

The protruding piece 51*b* is a plate-shaped portion arranged approximately parallel to the opening/closing body thickness direction (the fix piece 51*a* according to FIG. 6) and running to the outdoor side. At the end part on the opening/closing body opening direction side, a holding face 51*b*1 that holds the brake engage part 62*b* described later and a projection 51*b*2 that protrudes in the opening/closing body opening direction from the holding face 51*b*1 are included, thus forming an approximately hook shape. The protruding piece 51*b* is such that the projection 51*b*2 comes over and engages with the brake engage part 62*b* in a hook shape from the lower side (see FIG. 8), upon contact of the brake engage part 62*b* with the holding face 51*b*1.

The close prevention device 60 includes a fix member 61 fixed to the opening/closing body 10 side and a movable member 62 supported by the fix member 61 and integrally including the brake engage part 62*b* (see FIG. 3 and FIG. 4).

The fix member 61 is a member attached and fixed with respect to the opening/closing body 10. Within a cylinder part 61*a* inserted in the opening/closing body horizontal width direction, the shaft part 21 of the roller member 20 is inserted and supported to freely rotate.

The movable member 62 is configured to be pivotable between the engage possible position (see FIG. 8 and FIG. 10) in which engagement of the brake engage part 62*b* with respect to the first engaged part 51 is possible and the engage impossible position (see FIG. 7 and FIG. 9) in which engagement of the brake engage part 62*b* with respect to the first engaged part 51 is impossible, be maintained in the engage impossible position by being pulled by a traction member 83 of the traction mechanism 80 from the opening/closing body opening direction side, and pivot to the engage possible position side with its own weight upon loss of the tension of the traction member 83.

Figure 7:
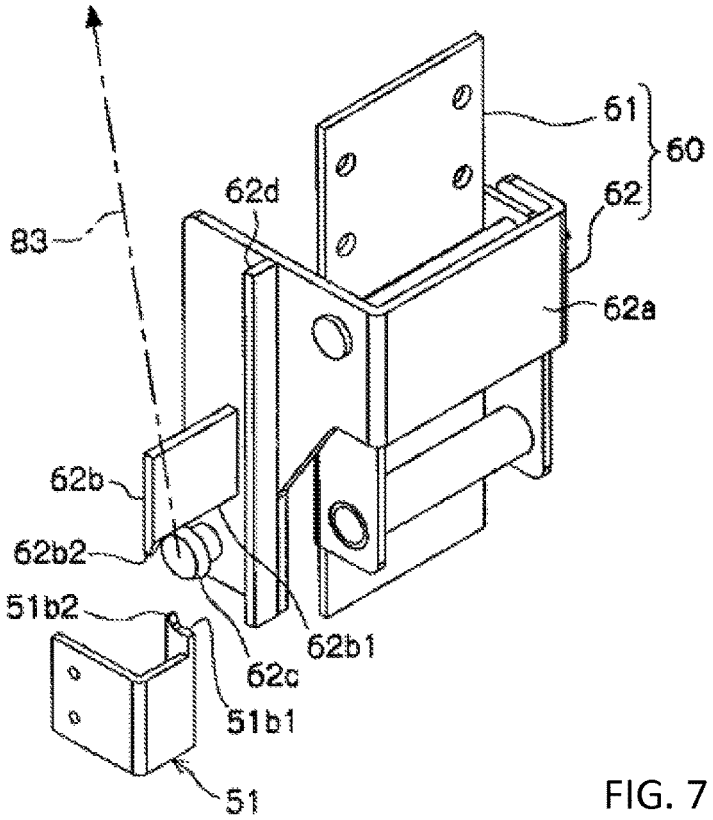
FIG. 7 is a perspective view showing the close prevention device in the engage impossible position.
Figure 8:
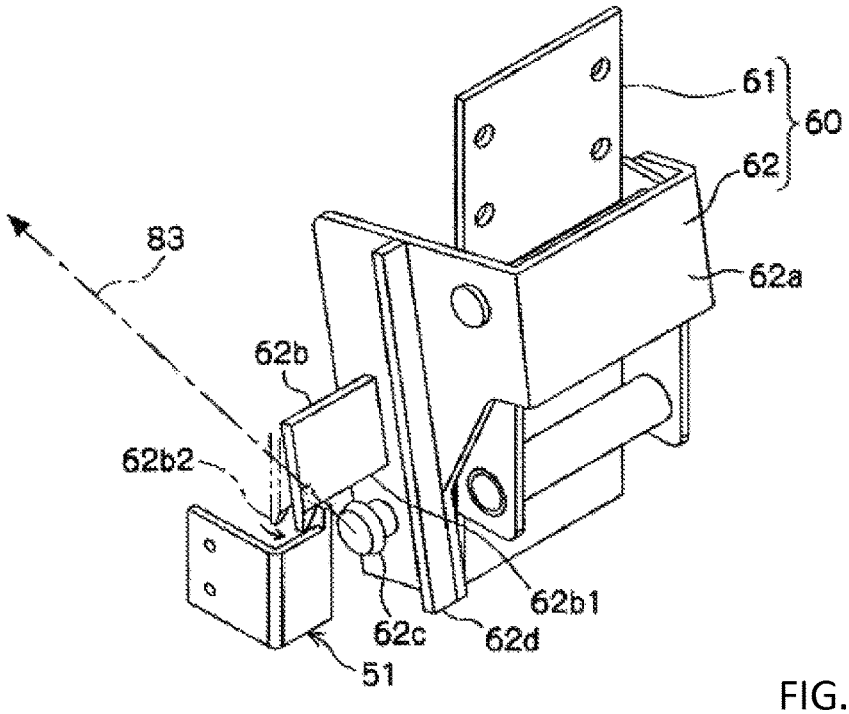
FIG. 8 is a perspective view showing the close prevention device in the engage possible position.

To illustrate in more detail, the movable member 62 includes a movable main body part 62*a* formed in an approximately U-shape that fits with the approximately protrusion-shaped fix member 61 protruding to the outdoor side in the opening/closing body thickness direction and the brake engage part 62*b* protruding into the space S along the opening/closing body horizontal width direction from the side face of the movable main body part 62*a*. In FIG. 7 and FIG. 8, reference numeral 62*d* denotes a reinforcement rib that inhibits the side part of the movable main body part 62*a* from being flexed by the tension of the traction member 83.

Figure 9:
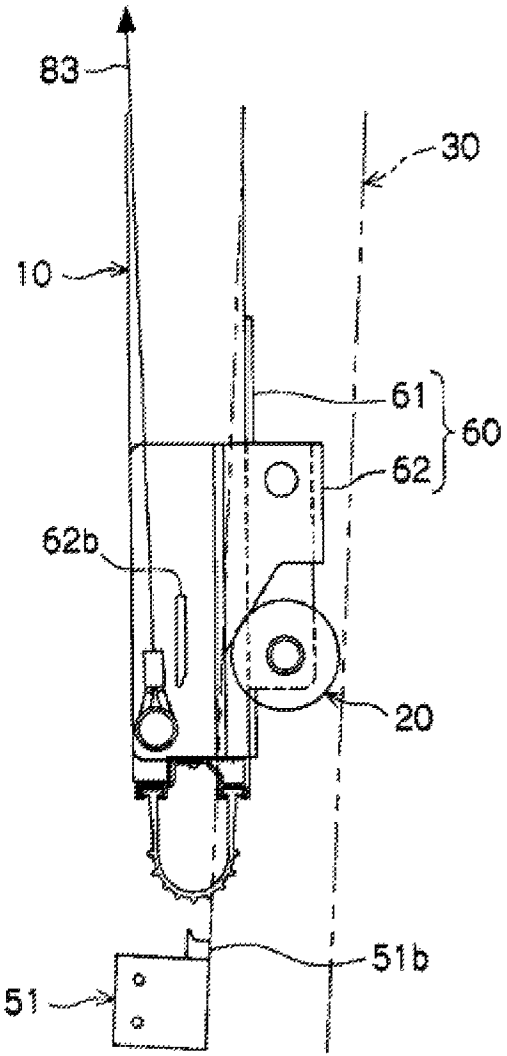
FIG. 9 is a side view of a main part of the opening/closing device of this embodiment, showing a state where the close prevention device is in the engage impossible position.

The movable main body part 62*a* is pivotally supported via a shaft member 61*b* with respect to the fix member 61, and the pivoting point is arranged in a position toward one side in the opening/closing body thickness direction (the indoor (right) side according to FIG. 9). At the movable main body part 62*a*, a traction object part 62*c* to be pulled by the traction member 83 protrudes in a part toward the lower end on the other side in the opening/closing body thickness direction (outdoor (left) side according to FIG. 9) relative to the pivoting point.

According to the example shown in the drawing, the brake engage part 62*b* is a rectangular plate-shaped member and is fixed to be directed in the vertical direction by fixing method such as welding to the side face of the movable main body part 62*a*.

The lower end part of the brake engage part 62*b* includes a contact surface 62*b*1 for contact with the first engaged part 51 and a projection 62*b*2 that protrudes downward from the contact surface 62*b*1, thus forming an approximately hook shape on the protruding end side. The brake engage part 62*b* is such that the projection 62*b*2 comes over and engages with the holding face 51*b*1 in a hook shape from the upper side (see FIG. 7 and FIG. 8), upon contact of the contact surface 62*b*1 with the holding face 51*b*1 of the first engaged part 51.

Figure 11:
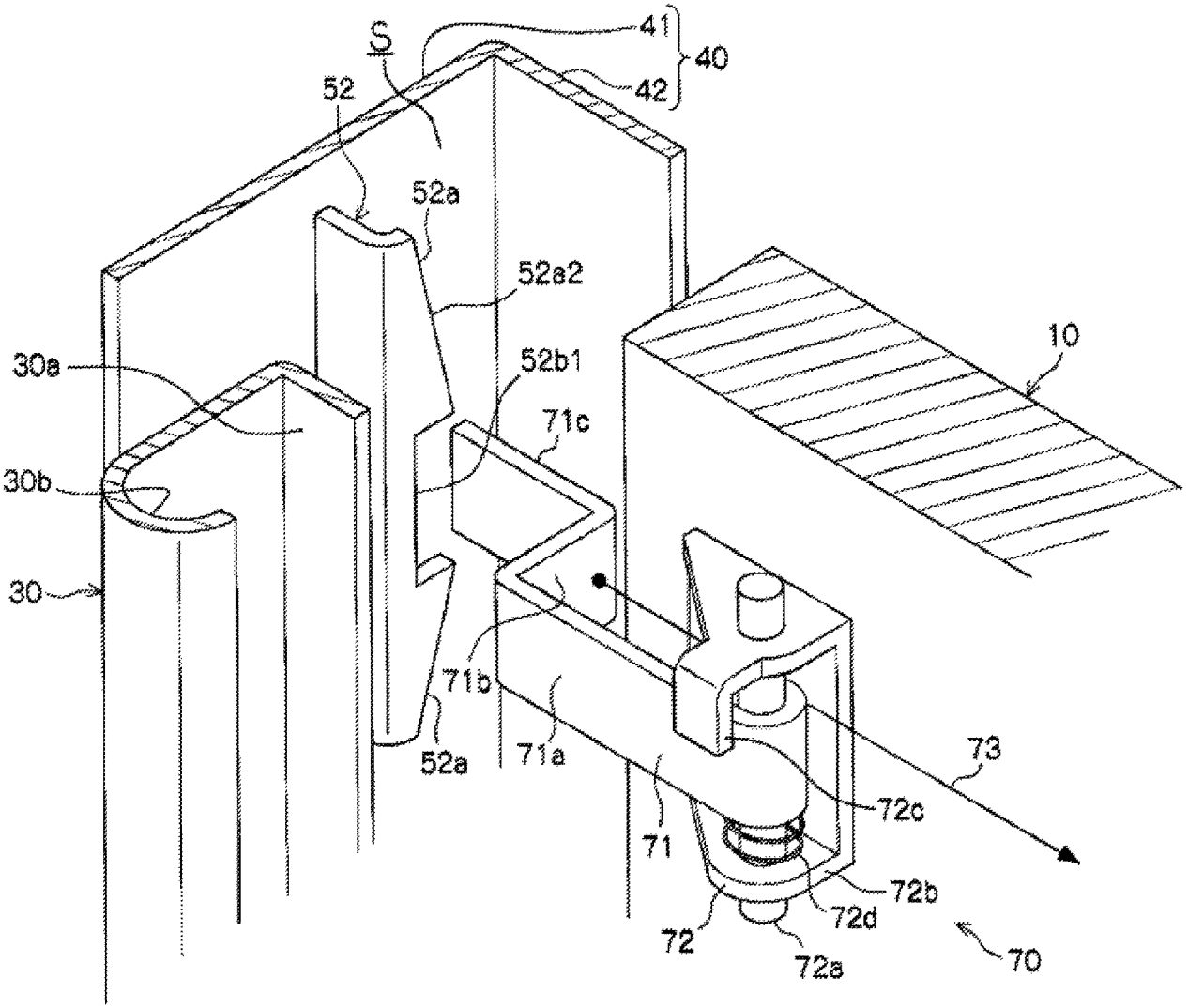
FIG. 11 is a perspective view showing one example of a lock mechanism.

The second engaged part 52 is a metal member with an L-shaped cross section that is arranged in the space S and fixed to an unmovable portion (the guide rail 30 according to the example shown in the drawing), as shown in FIG. 11. The second engaged part 52 includes, at one piece 52*a* protruding in the opening/closing body thickness direction, a depressed part 52*b*1 that is detached by the lock engage part 71 of the lock mechanism 70 described later and an inclined face 52*a*2 inclined in a mountain shape toward the depressed part 52*b*1.

The depressed part 52*b*1 is formed in a depressed shape with a slightly greater width than the vertical width of the lock engage part 71. The inclined face 52*a*2 prevents the lock engage part 71 from wobbling and suddenly seizing to the upper or lower end part or the like of the one piece 52*a*, due to vibration during an opening/closing operation of the opening/closing body 10.

Figure 13:
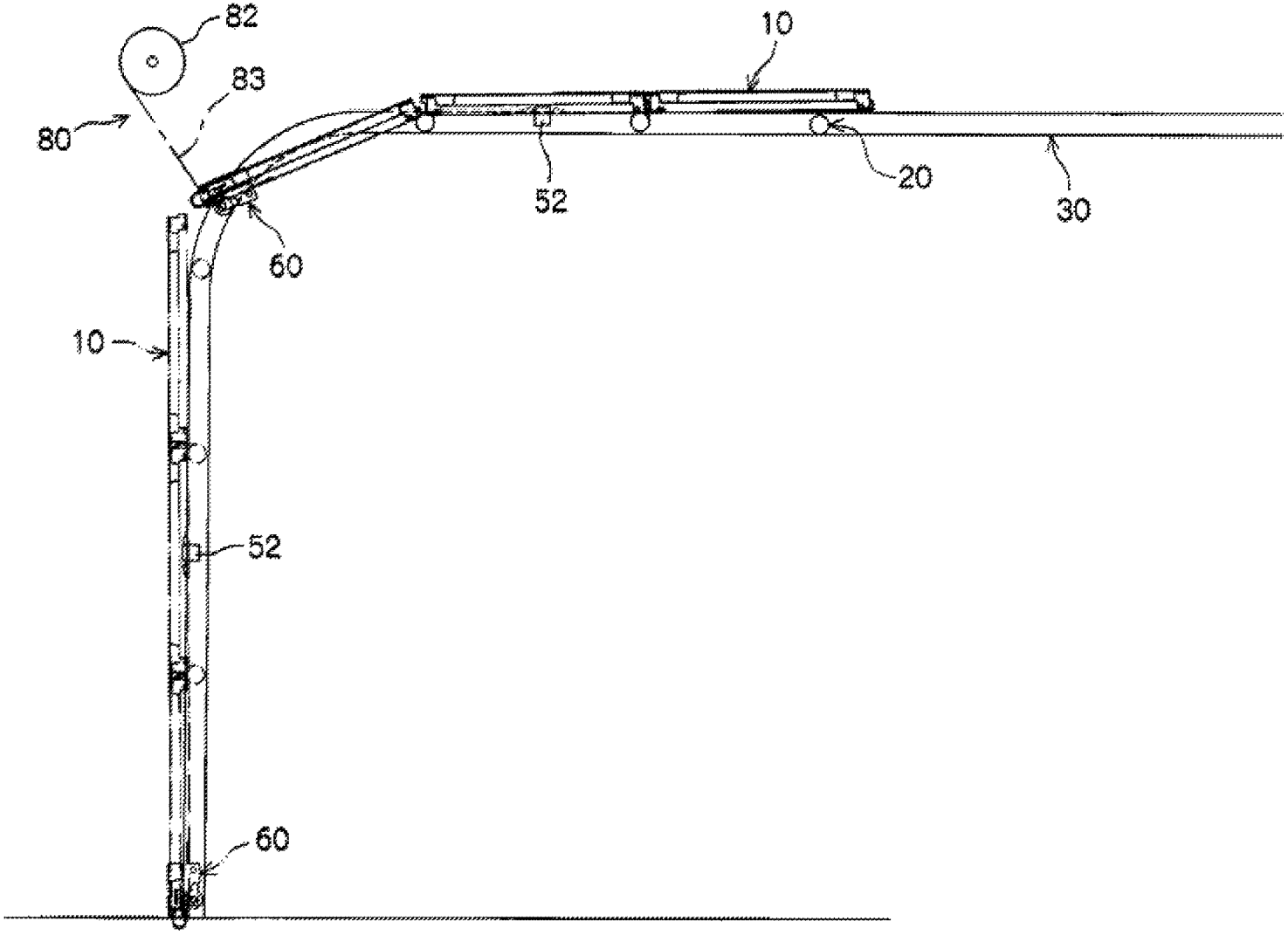
FIG. 13 is a view showing the operation of this embodiment from the side.

The second engaged part 52 is provided in two spots, in a position that opposes the lock engage part 71 upon the opening/closing body 10 being fully closed and a position that opposes the lock engage part 71 upon the opening/closing body 10 being fully opened (see FIG. 13). As a different example, provision in a position that opposes the lock engage part 71 in a partly opened state is also possible. Further, as a different example, it is possible to omit one of the second engaged part 52 on the fully opened side and the second engaged part 52 on the fully closed side in FIG. 13 or to change the number or position in accordance with the purpose of use of the opening/closing device 1.

Figure 12:
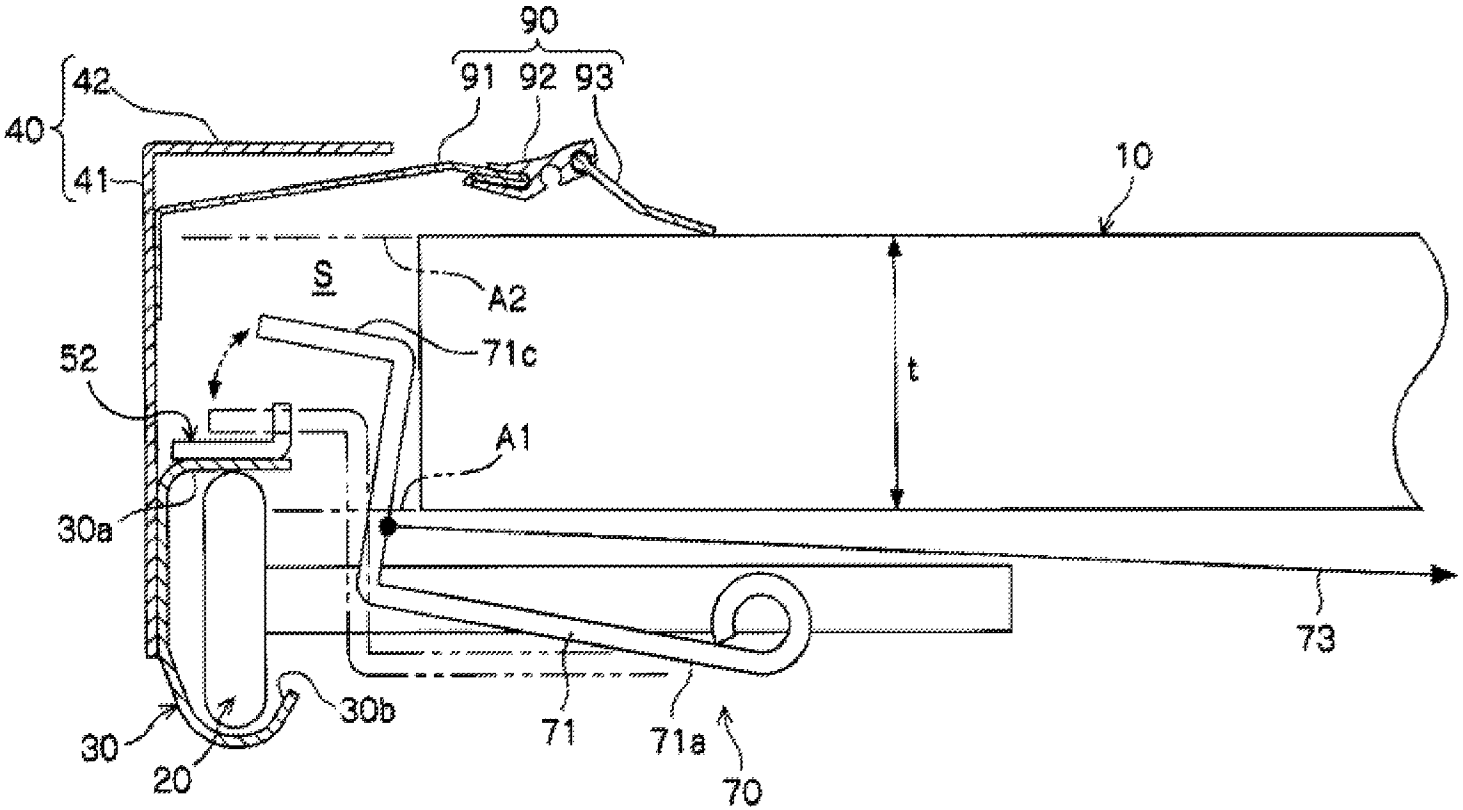
FIG. 12 is an operation illustrating view showing the same lock mechanism.

As shown in FIG. 11 and FIG. 12, the lock mechanism 70 includes the lock engage part 71 that pivots in the opening/closing body thickness direction to detach from the second engaged part 52, a support member 72 that supports each lock engage part 71 to be pivotable, a cord-like member 73 connected at one end side to the lock engage part 71, a pull operation part 74 connected to the other end side of the cord-like member 73, and the like. The lock engage part 71, the support member 72, the cord-like member 73, and the like are provided to be symmetrical with respect to the opening/closing body 10 (see FIG. 1).

The lock engage part 71 has an approximately crank shape in planar view that includes a first piece 71*a* that is in the opening/closing body horizontal width direction along the face of the opening/closing body 10, a second piece 71*b* that is connected to the first piece 71*a* and in the opening/closing body thickness direction along the width direction end face of the opening/closing body 10, and a third piece 71*c* that is connected to the second piece 71*b* and runs in the opening/closing body horizontal width direction.

The base end side (right end side according to FIG. 12) of the first piece 71*a* is supported to freely pivot by the support member 72 described later.

To the second piece 71*b*, one end side of the cord-like member 73 (e.g., metal wire) that is in the opening/closing body horizontal width direction is attached.

The third piece 71*c* is formed to detach from the second engaged part 52 in a protrusion/depression shape by pivoting in the opening/closing body thickness direction.

The support member 72 is configured of a shaft part 72*a* that supports the lock engage part 71 to freely rotate, a support part 72*b* that supports the shaft part 72*a* and is fixed to the face of the opening/closing body 10, a restricting part 72*c* that is provided integrally with the support part 72*b* and restricts pivoting of the lock engage part 71, and an urging member 72*d* that urges the lock engage part 71 in the engaging direction with respect to the second engaged part 52.

The restricting part 72*c* is in a position on the tip end side (free end side) of the lock engage part 71 relative to the shaft part 72*a* to restrict the pivot amount upon the lock engage part 71 pivoting in a direction away from the opening/closing body 10 and prevent the lock engage part 71 from seizing to the upper end or lower end of the second engaged part 52.

That is, in the case of a hypothetical configuration in which the restricting part 72*c* is absent, there is a risk of the lock engage part 71 wobbling in the opening/closing body thickness direction due to vibration at the time of an opening/closing operation and seizing to the upper end or lower end of the second engaged part 52. However, according to this embodiment, such a failure described above can be prevented, since the pivot amount (the wobbling) of the lock engage part 71 is restricted by the restricting part 72*c*.

According to the example shown in the drawing, the urging member 72*d* is a torsion coil spring wound around the shaft part 72*a*. One end side is attached to the lock engage part 71, and the other end side is attached to the support part 72*b*. The urging member 72*d* urges the lock engage part 71 to pivot in an engaging direction with respect to the second engaged part 52.

It is possible to replace the urging member 72*d* with a different form, such as a tension spring provided between the first piece 71*a* and the opening/closing body 10.

The other end side of the cord-like member 73, with respect to the one end side attached to the lock engage part 71, is connected to the pull operation part 74 (see FIG. 1).

The pull operation part 74 is configured to pivot between a state of not pulling the cord-like member 73 and a state of pulling and seizing the cord-like member 73.

Thus, in a state where the cord-like member 73 is not pulled by the pull operation part 74, the lock engage part 71 pivots to the second engaged part 52 side due to the urging force of the urging member 72*d*. In the case where the cord-like member 73 is pulled and seized by the pull operation part 74, the lock engage part 71 pivots and departs from the second engaged part 52.

The traction mechanism 80 includes a shaft part 81 arranged in the opening/closing body width direction on the opening direction side of the opening/closing body 10, reel parts 82 supported at both end sides of the shaft part 81, the traction member 83 that is wound or unwound by each reel parts 82, and traction sources 84 that urge the shaft part 81 such that the traction member 83 is wound by the reel part 82 (see FIG. 1).

The shaft part 81 is arranged in the opening/closing body width direction to be in a position on an upward extension line from the opening/closing body 10 in a fully closed state, and each of both end sides is supported to freely pivot via a bearing bracket or the like with respect to an unmovable portion (e.g., frame or the like to which the opening/closing device 1 is to be installed).

Each reel part 82 is an approximately cylinder-shaped member capable of winding and unwinding the traction member 83, and the center part is fixed to one end side of the shaft part 81.

The traction member 83 is a metal wire. The end part on the opening/closing body opening direction side is attached to the outer circumference face of the reel part 82, and the end part on the opening/closing body closing direction side is attached to the movable member 62 of the close prevention device 60.

According to the example shown in the drawing, the traction source 84 is a spring that urges the shaft part 81 in the winding rotation direction by being attached at one end side to the shaft part 81 and attached at the other end side to an unmovable portion. As a different example of the traction source 84, a mechanism that causes the shaft part 81 to rotate in the winding rotation direction by weight of a spindle member, a mechanism that causes the shaft part 81 to rotate in the winding rotation direction by power of an electric motor, or the like is also possible.

Next, regarding the opening/closing device 1 with the configuration described above, a characteristic effect will be described in detail.

As an initial state, it is assumed that the lock engage part 71 of the lock mechanism 70 is in a state not engaged with the second engaged part 52.

Upon a normal opening/closing operation and storage operation of the opening/closing body 10, the movable member 62 of the close prevention device 60 is maintained in the engage impossible position (see FIG. 7 and FIG. 9) by being pulled by the traction member 83 against its own weight. Thus, the opening/closing body 10 performs an opening/closing operation and a storage operation without receiving a brake force of the close prevention device 60.

Figure 10:
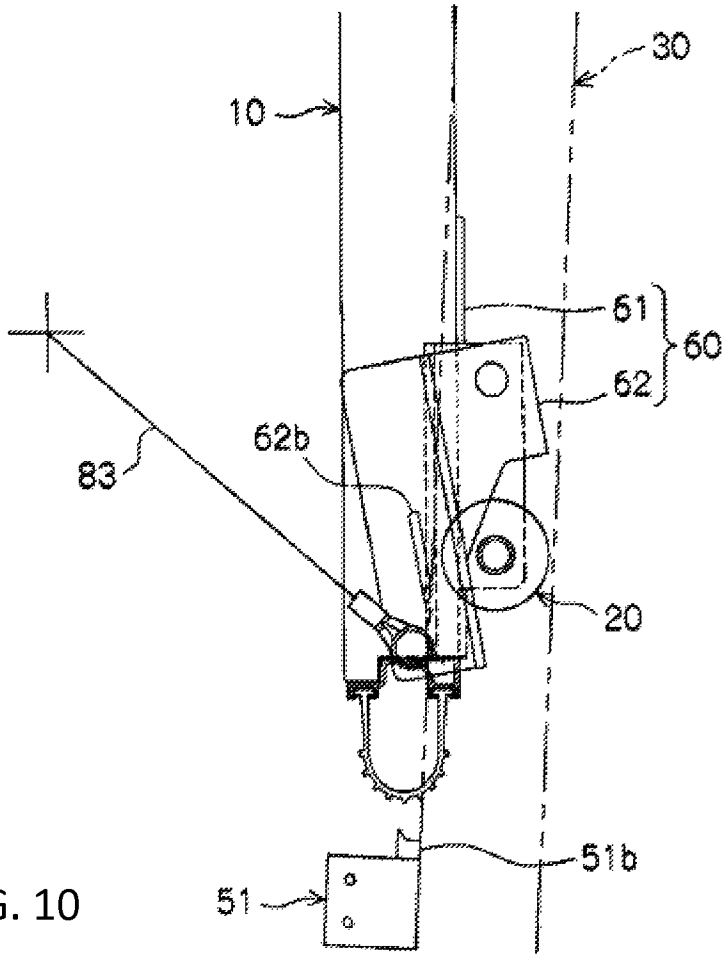
FIG. 10 is a side view of a main part of the opening/closing device of this embodiment, showing a state where the close prevention device is in the engage possible position.

In the case where the tension of the traction member 83 has decreased due to trouble on the traction mechanism 80 side, such as the traction member 83 being cut, idle spinning of the reel part 82 that winds the traction member 83, or idle spinning of the traction source 84 that urges the reel part 82 in the winding direction, the movable member 62 pivots to the indoor side (counterclockwise direction according to the example shown in the drawing) with its own weight, as shown in FIG. 8 and FIG. 10.

Then, the brake engage part 62*b* of the movable member 62 comes to the engage possible position opposing, in the vertical direction, the protruding piece 51*b* of the first engaged part 51. Therefore, even in the case where the opening/closing body 10 has suddenly descended, the sudden descent of the opening/closing body 10 can be stopped, since the brake engage part 62*b* contacts the first engaged part 51.

To illustrate in more detail, the contact surface 62*b*1 and the projection 62*b*2 of the brake engage part 62*b* engage in a hook shape with the holding face 51*b*1 of the first engaged part 51 upon the contact. Simultaneously, the holding face 51*b*1 and the projection 51*b*2 of the first engaged part 51 also engage in a hook shape with the contact surface 62*b*1 of the brake engage part 62*b*. Therefore, the brake engage part 62*b* can be prevented from bouncing and not engaging due to impact or reaction upon the contact.

During the opening/closing operation of the opening/closing body 10, the brake engage part 62*b* and the first engaged part 51 are encompassed by the end part in the horizontal width direction of the opening/closing body 10, the guide rail 30, the support member 40, and the airtight unit 90. Therefore, an object or the like being sandwiched between the engage spots or an object or the like touching the brake engage part 62*b* or the first engaged part 51 can be prevented.

Since the configuration is such that the brake engage part 62*b* and the first engaged part 51 are arranged within the space S as described above and a detach part is absent outside the space S, members or the like protruding in the opening/closing body thickness direction at the width direction end part of the opening/closing body 10 can be reduced, thus enabling the structure of the perimeter of the guide rail 30 to be configured with a relatively thin body.

When not locked in the fully closed position of the opening/closing body 10, the tip end side part of the lock engage part 71 (specifically, the third piece 71*c* and a part of the second piece 71*b*) is arranged in the space S.

In the case where the cord-like member 73 is loosened by an operation of the pull operation part 74 in the fully closed position of the opening/closing body 10, the lock engage part 71 is caused to pivot to the indoor side within the space S by the urging member 72*d* to engage with the second engaged part 52 in a protrusion/depression shape, such that the opening/closing body 10 is in a locked state where opening/closing is impossible.

The lock engage part 71 and the second engaged part 52 are encompassed by the end part in the horizontal width direction of the opening/closing body 10, the guide rail 30, the support member 40, and the airtight unit 90. Therefore, an object or the like being sandwiched between the engage spots or an object or the like touching the lock engage part 71 or the second engaged part 52 can be prevented.

In the case where the cord-like member 73 is loosened by an operation of the pull operation part 74 in the fully opened position of the opening/closing body 10, the lock engage part 71 is caused to pivot by the urging member 72*d* to engage with the second engaged part 52 in a protrusion/depression shape, such that the opening/closing body 10 is in a locked state where opening/closing is impossible (see FIG. 11 to FIG. 13).

Thus, in this state, the opening/closing body 10 in the fully opened position can be prevented from suddenly falling or oscillating back and forth on the store rail part 32.

In the fully opened position, the support member 40 or the like is not in a position around the lock engage part 71 and the second engaged part 52. Since these are in a relatively high position, an object or the like touching these can be prevented.

Pulling the cord-like member 73 by an operation of the pull operation part 74 can release the locked state in the fully closed position and the fully opened position described above, since the lock engage part 71 pivots in the opposite direction and disengages from the second engaged part 52.

In the fully opened position, the position of the pull operation part 74 is high, and there is a risk that an operation with respect to the pull operation part 74 becomes difficult. Therefore, as necessary, a mechanism or the like to operate the pull operation part 74 with a member that runs downward may be added.

Next, a different example of the opening/closing device of this embodiment will be described. In an opening/closing device 2 shown below, a partial change has been made from the opening/closing device 1. Therefore, parts approximately similar to the opening/closing device 1 are denoted by the same reference numeral to omit redundant detailed descriptions.

In contrast to the opening/closing device 1, the opening/closing device 2 shown in FIG. 1 and FIG. 14 to FIG. 20 is configured such that the first engaged part 51 is replaced with a first engaged part 51', and the close prevention device 60 is replaced with the close prevention device 60'.

The first engaged part 51' is a portion to be detached by a brake engage part 62*b*' of the close prevention device 60'. To illustrate in detail, as shown in FIG. 17 and FIG. 18, included are a flat plate-shaped fix piece 51*a*' fixed to the inner face of the support member 40 and a protruding piece 51*b*' connected to the fix piece 51*a*' and provided to protrude to the opening/closing body opening direction side relative to the fix piece 51*a*', thus forming an approximately L-shaped sectional surface according to the example shown in the drawing.

Figure 14:
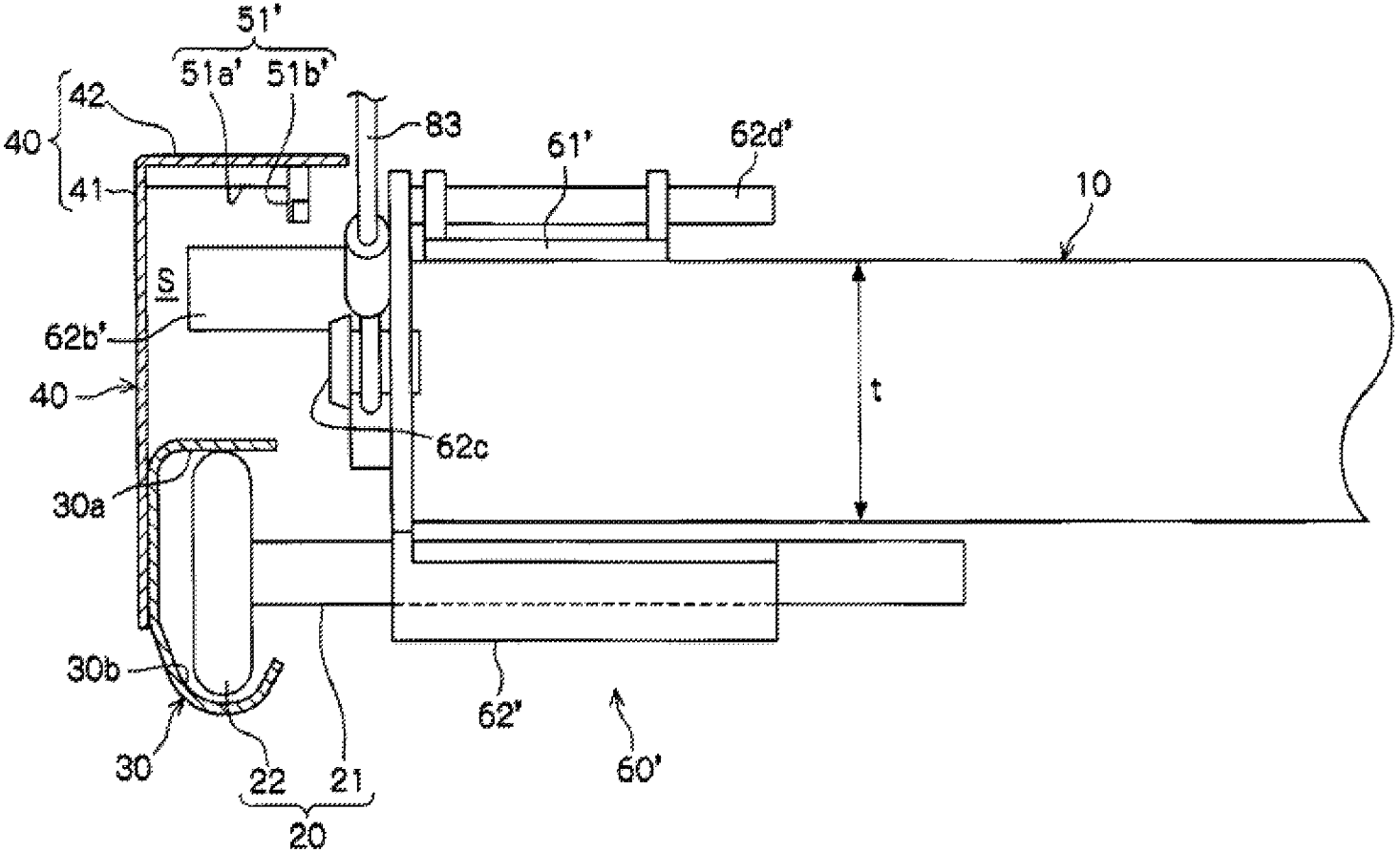
FIG. 14 is a sectional view of a main part in a different example of the opening/closing device of this embodiment.

A plurality of the first engaged parts 51' are provided with intervals in the vertical direction, and each is fixed to the cover piece 42 of the support piece 41 (see FIG. 14).

Figure 17:
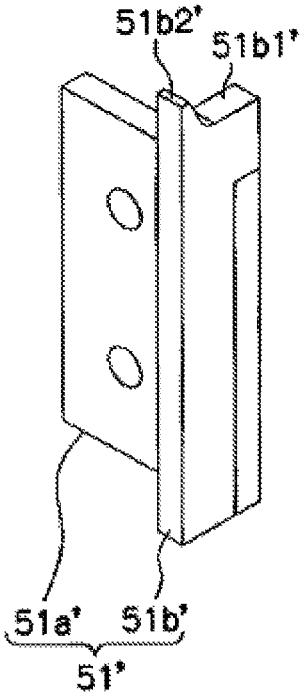
FIG. 17 is a perspective view showing a different example of the engaged part.
Figure 18:
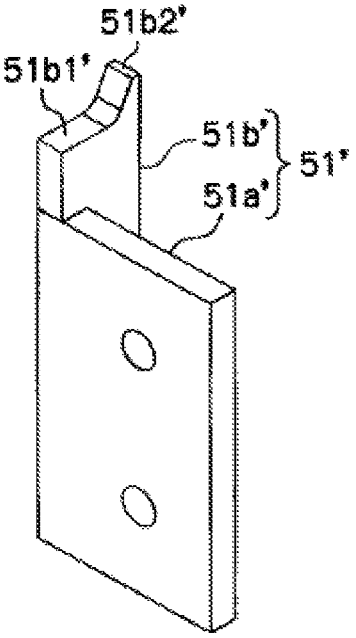
FIG. 18 is a perspective view showing the same engaged part from a different viewpoint.

The protruding piece 51*b*' is a plate-shaped portion arranged approximately parallel to the opening/closing body thickness direction, as shown in FIG. 17 and FIG. 18. At the end part on the opening/closing body opening direction side, a holding face 51*b*1' that holds the brake engage part 62*b*' and a projection 51*b*2' that protrudes in the opening/closing body opening direction from the holding face 51*b*1' are included, thus forming an approximately hook shape. The protruding piece 51*b*' is such that the projection 51*b*2' comes over and engages with the brake engage part 62*b*' in a hook shape from the lower side (see FIG. 20), upon contact of the brake engage part 62*b*' with the holding face 51*b*1'.

Figure 15:
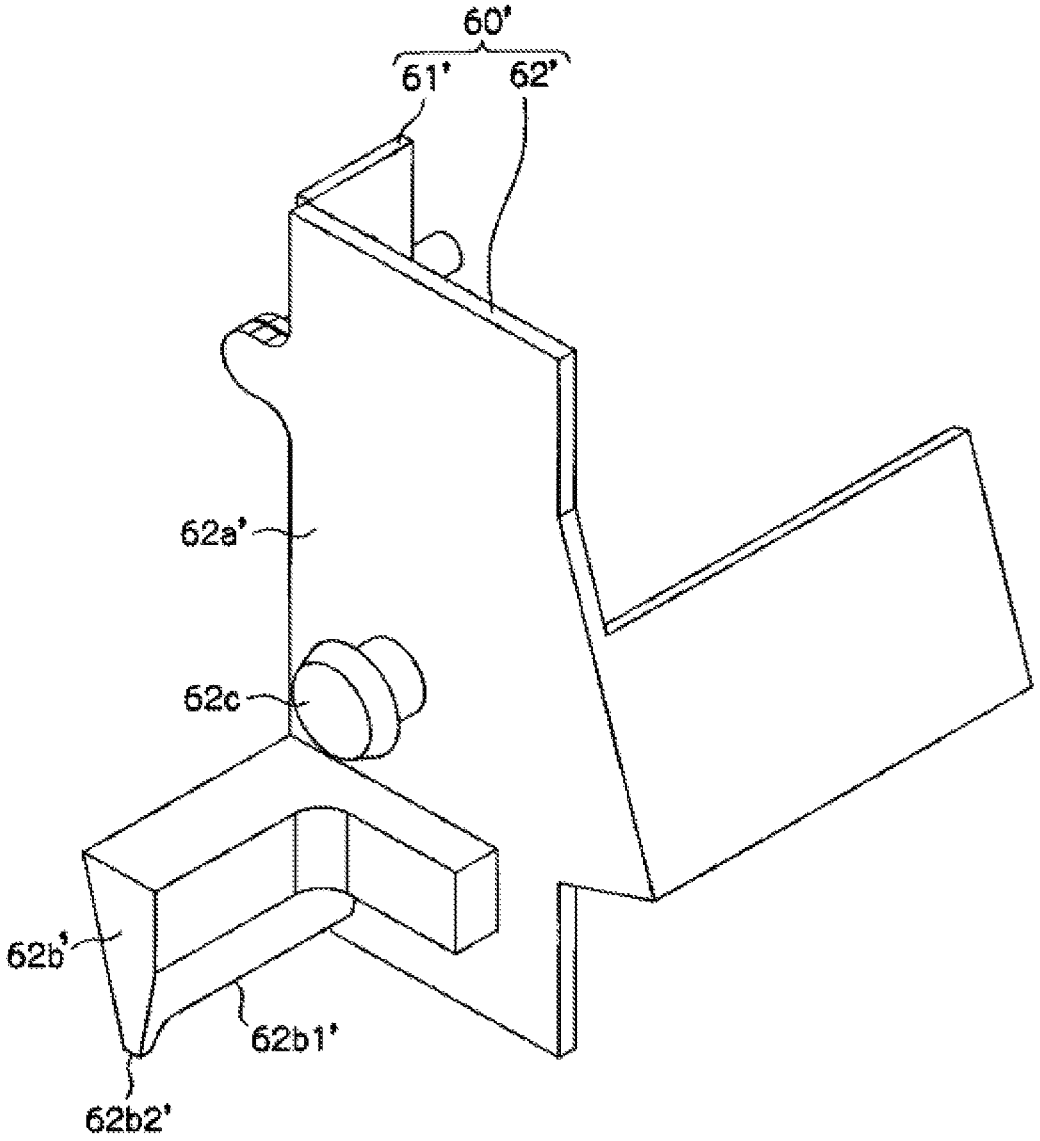
FIG. 15 is a perspective view of a main part showing a different example of the close prevention device.
Figure 16:
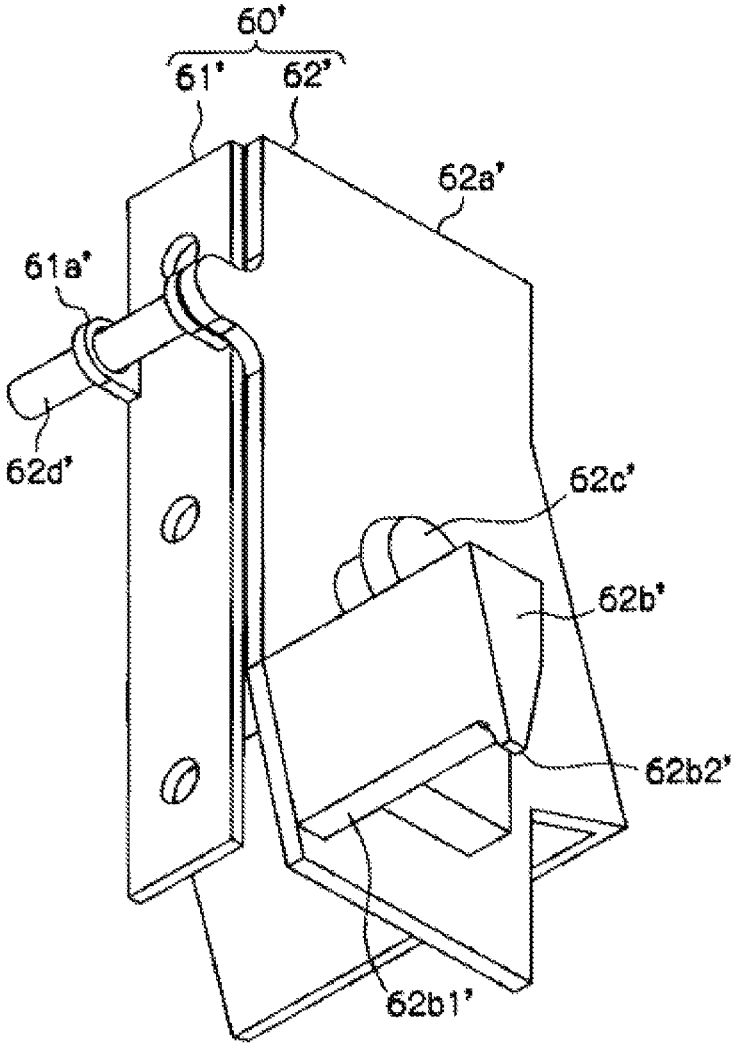
FIG. 16 is a perspective view showing the same close prevention device from a different viewpoint.

As shown in FIG. 14 to FIG. 16, the close prevention device 60' includes a fix member 61' fixed to the opening/closing body 10 side and a movable member 62' supported by the fix member 61' and integrally including the brake engage part 62*b*'.

The fix member 61' is a member attached and fixed with respect to the surface (face on the outdoor side, see FIG. 14) of the opening/closing body 10. A shaft part 62*d*' of the movable member 62 is supported to freely rotate via a bearing part 61*a*'.

The movable member 62' is configured to be pivotable between the engage possible position (see FIG. 20) in which engagement of the brake engage part 62*b*' with respect to the first engaged part 51' is possible and the engage impossible position (see FIG. 19) in which engagement of the brake engage part 62*b*' with respect to the first engaged part 51' is impossible, be maintained in the engage impossible position by being pulled by the traction member 83 of the traction mechanism 80 from the opening/closing body opening direction side, and pivot to the engage possible position side with its own weight upon loss of the tension of the traction member 83.

To illustrate in more detail, the movable member 62' includes a movable main body part 62*a*' supported to freely rotate via the shaft part 62*d*' with respect to the fix member 61' and the brake engage part 62*b*' protruding into the space S along the opening/closing body horizontal width direction from the side face of the movable main body part 62*a*'.

Figure 19:
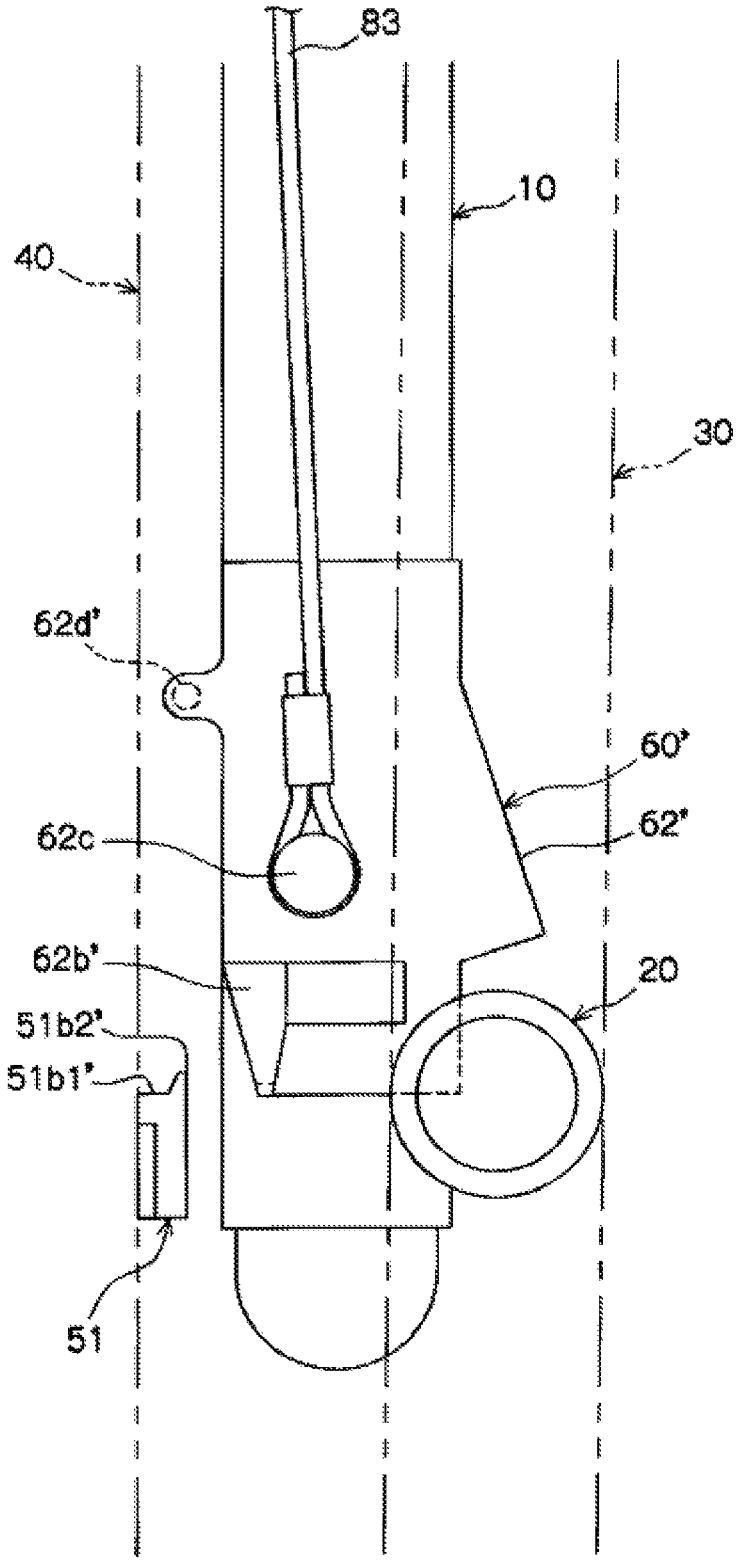
FIG. 19 is a side view of a main part of an opening/closing device in a second embodiment, showing a state where a close prevention device is in the engage impossible position.

The movable main body part 62*a*' is pivotally supported via the shaft part 62*d*' with respect to the fix member 61', and the pivoting point (center of the shaft part 62*d*') is arranged in a position toward one side in the opening/closing body thickness direction (the indoor (left) side according to FIG. 19). At the movable main body part 62*a*', the traction object part 62*c* to be pulled by the traction member 83 protrudes in a part toward the lower end on the other side in the opening/closing body thickness direction (outdoor (right) side according to FIG. 19) relative to the pivoting point.

The brake engage part 62*b*' is fixed by fixing method such as welding to the side face of the movable main body part 62*a*' and protrudes in the opening/closing body horizontal width direction from the side face. According to the example shown in the drawing, the brake engage part 62*b*' is formed with an approximately wedge-shaped sectional surface with a narrower width toward the lower side (see FIG. 15). The lower end part includes a contact surface 62*b*1' that contacts the first engaged part 51' and a projection 62*b*2' that protrudes in the opening/closing body closing direction from the contact surface 62*b*1', thus forming an approximately hook shape at the protruding end side. The brake engage part 62*b*' is such that the projection 62*b*2' comes over and engages with the holding face 51*b*1' in a hook shape from the upper side (see FIG. 20), upon contact of the contact surface 62*b*1' with the holding face 51*b*1' of the first engaged part 51'.

Figure 20:
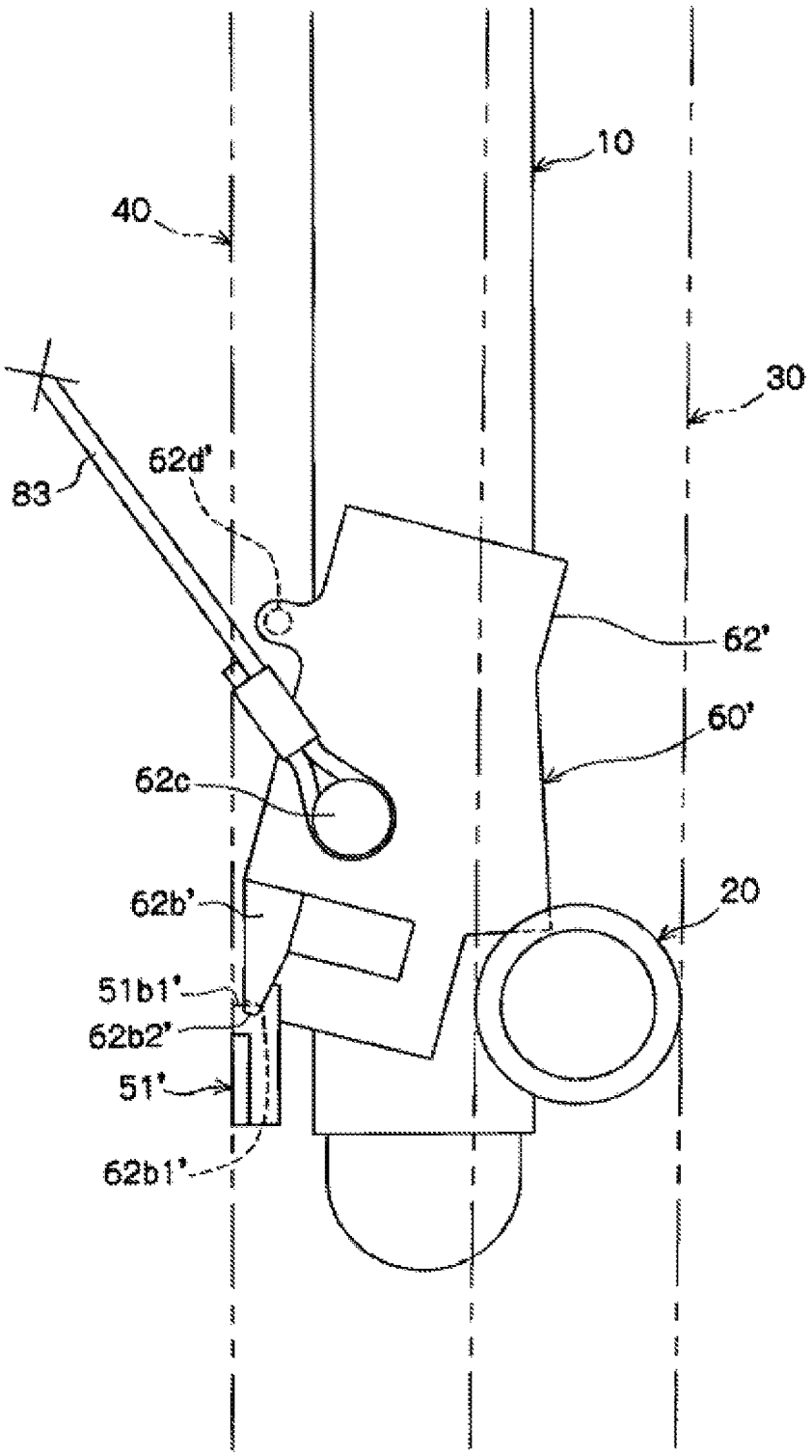
FIG. 20 is a side view of a main part of the opening/closing device in the second embodiment, showing a state where the close prevention device is in the engage possible position.

In FIG. 14, FIG. 19, and FIG. 20, the roller member 20 is supported to freely rotate by the opening/closing body 10, so as not to interfere with the close prevention device 60.

Thus, upon a normal opening/closing operation and storage operation of the opening/closing body 10 with the opening/closing device 2 shown in FIG. 1 and FIG. 14 to FIG. 20, the movable member 62' of the close prevention device 60' is maintained in the engage impossible position (see FIG. 19) by being pulled by the traction member 83 against its own weight.

In the case where the tension of the traction member 83 has decreased due to trouble on the traction mechanism 80 side, such as the traction member 83 being cut, idle spinning of the reel part 82 that winds the traction member 83, or idle spinning of the traction source 84 that urges the reel part 82 in the winding direction, the movable member 62' pivots to the outdoor side (clockwise direction according to the example shown in the drawing) with its own weight, as shown in FIG. 20.

Then, the brake engage part 62*b*' of the movable member 62' comes to the engage possible position opposing the protruding piece 51*b*' of the first engaged part 51'. Therefore, even in the case where the opening/closing body 10 has suddenly descended, the brake engage part 62*b*' contacts the first engaged part 51', and the sudden descent of the opening/closing body 10 can be stopped.

To illustrate in more detail, the contact surface 62*b*1' and the projection 62*b*2' of the brake engage part 62*b*' engage in a hook shape with the holding face 51*b*1' of the first engaged part 51' upon the contact. Simultaneously, the holding face 51*b*1' and the projection 51*b*2' of the first engaged part 51' also engage in a hook shape with the contact surface 62*b*1' of the brake engage part 62*b*'. Thus, the brake engage part 62*b*' can be prevented from bouncing and not engaging due to impact or reaction upon the contact.

During the opening/closing operation of the opening/closing body 10, the brake engage part 62*b*' and the first engaged part 51' are in a position within the space S encompassed by the end part in the horizontal width direction of the opening/closing body 10, the guide rail 30, and the support member 40. Therefore, an object or the like being sandwiched between the engage spots or an object or the like touching the brake engage part 62*b*' or the first engaged part 51' can be prevented.

Since the configuration is such that the brake engage part 62*b*' and the first engaged part 51' are arranged within the space S as described above and a detach part is absent outside the space S, members or the like protruding in the opening/closing body thickness direction at the width direction end part of the opening/closing body 10 can be reduced, thus enabling the structure of the perimeter of the guide rail 30 to be configured with a relatively thin body.

In one example shown in FIG. 14, the airtight unit 90 is omitted. However, the airtight unit 90 may be added in a similar manner to the opening/closing device 1 to effectively prevent an object or the like from touching the brake engage part 62*b*' or the first engaged part 51'.

According to the embodiment described above, the first engaged part 51 (or 51) and the second engaged part 52 are each separate members. However, in a different preferred embodiment, it may be such that the first engaged part 51 (or 51') and the second engaged part 52 are common members or portions with the same shape, and both of the brake engage part 62*b* (or 62*b*) and the lock engage part 71 detach therefrom.

According to the embodiment described above, the first engaged part 51 (or 51') and the second engaged part 52 are fixed to the guide rail 30 or the support member 40. However, in a different example, it is possible that the first engaged part 51 (or 51') and the second engaged part 52 are formed integrally with the guide rail 30 or the support member 40.

Figure 21:
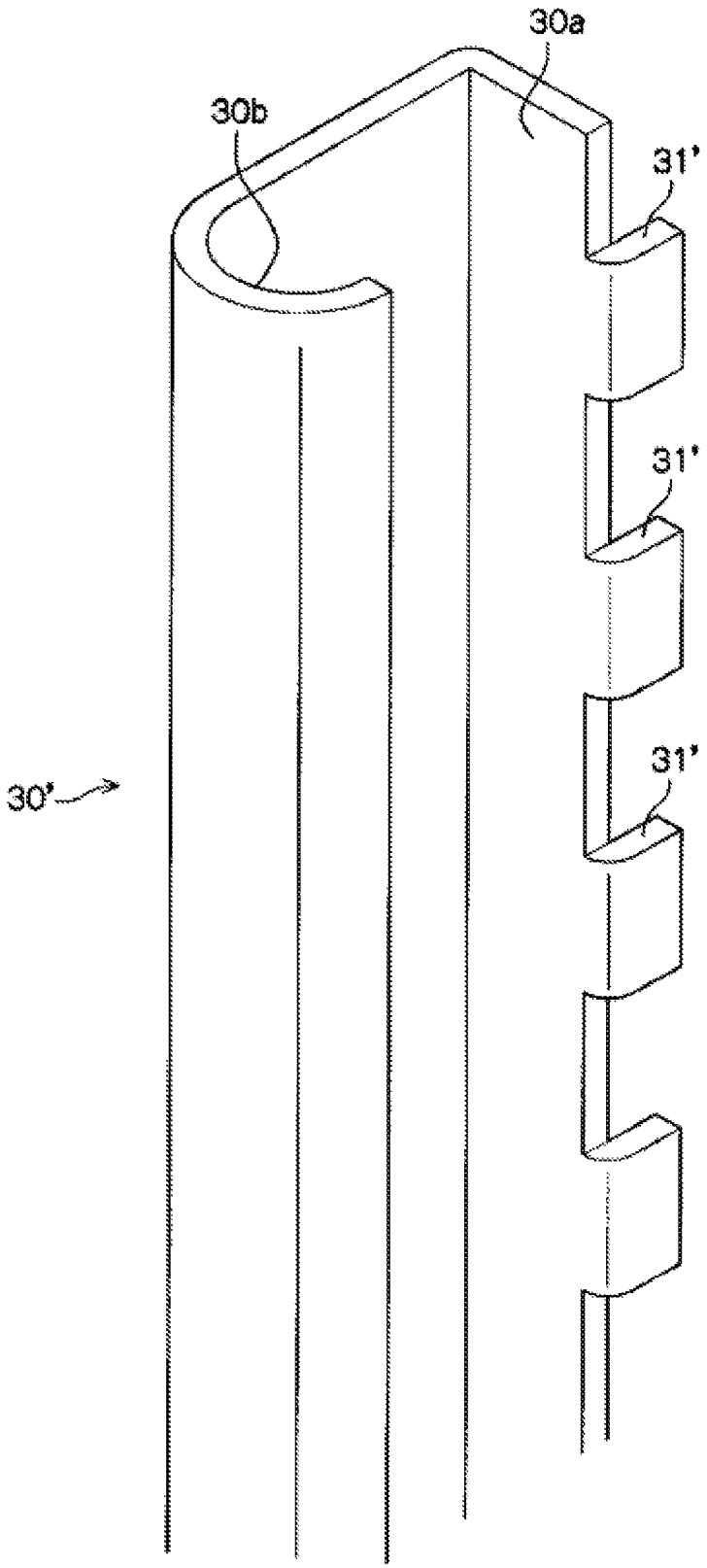
FIG. 21 is a perspective view showing a different example of a guide rail.

For example, in a guide rail 30' shown in FIG. 21, an engaged part 31' that can be the first engaged part and the second engaged part is formed in the guide rail 30' itself.

In the guide rail 30', the respective engaged parts 31' are depression/protrusion parts provided at intervals in the vertical direction at opposite positions to the brake engage part 62*b* and/or the lock engage part 71.

With this configuration, the brake engage part 62*b* contacts and seizes to the upper face of a protrusion part of which the engaged part 31' is configured. The lock engage part 71 fits with and seizes to a depression part of which the engaged part 31' is configured.

According to the embodiment described above, a plurality of the first engaged parts 51 and the second engaged parts 52 are provided along the guide rail 30. However, in a different example, it is possible that there is one of one or both of the first engaged part 51 and the second engaged part 52.

According to the embodiment described above, the second engaged part 52 is formed in a depression shape, so that the lock engage part 71 in the locked state does not move in both the opening/closing body opening direction and the opening/closing body closing direction. However, in a different example, it is also possible that the second engaged part 52 is in a different shape such as a step shape, so that the lock engage part 71 in the locked state does not move in only one of the opening/closing body opening direction and the opening/closing body closing direction.

According to the embodiment described above, the brake engage part 62*b* is in a position to be engageable with the first engaged part 51 by pivoting to the opening/closing body thickness direction. However, in a different example, a form in which the brake engage part is in a position to be engageable with the first engaged part by pivoting along the face of the opening/closing body or a form in which the brake engage part is in a position to be engageable with the first engaged part by sliding in the opening/closing body horizontal width direction is also possible.

According to the embodiment described above, the lock engage part 71 detaches from the second engaged part 52 by pivoting to the opening/closing body thickness direction. However, in a different example, a form in which the lock engage part detaches from the second engaged part by pivoting along the face of the opening/closing body, a form in which the lock engage part detaches from the second engaged part by sliding in the opening/closing body horizontal width direction, or the like is also possible.

According to the embodiment described above, the close prevention device 60 and the lock mechanism 70 with the structure described above are included with respect to the overhead door, as a particularly preferable specific example. However, in a different example, it is also possible that the close prevention device and the lock mechanism with approximately the same structure are included in an opening/closing device other than an overhead door, such as a shutter device.

In the case where a reinforcement rib, seat plate, or the like is provided over approximately the entire length in the opening/closing body horizontal width direction in a part on the lower side relative to the close prevention device 60 (or the lock mechanism 70) in the opening/closing body 10 in the embodiment described above, it is preferable that the protruding amount of the close prevention device 60 (or the lock mechanism 70) in the opening/closing body thickness direction from the face of the opening/closing body 10 is smaller than the protruding amount (or is the same as the protruding amount) of the reinforcement rib, seat plate, or the like in the protruding direction. With this configuration, it can be expected that contact with the close prevention device 60 (or the lock mechanism 70) is avoided as a result, upon a user or the like trying to avoid contact with the reinforcement rib, seat plate, or the like that is relatively easily visible.

In the case where the second engaged part 52 exists in the way of the movement of the opening/closing body 10 between the fully opened position and the fully closed position in the embodiment described above, the configuration is obviously such that the interference of the brake engage part 62*b* with the second engaged part 52 to obstruct the opening/closing operation is avoided at the time of a normal operation. Note that, as a configuration to be added to the embodiment described above, it is also possible that the brake engage part 62*b* is caused to engage with the second engaged part 52 at the time of an abnormality to proactively inhibit the opening/closing operation or descent of the opening/closing body 10.

In the embodiment described above, the close prevention device 60 and the first engaged part 51 as well as the lock mechanism 70 and the second engaged part 52 are both included, as a particularly preferable specific example. However, in a different example, a configuration in which one is omitted is also possible.

In a different example, although omitted in the drawing, it is also possible to provide the second engaged part 52 (see FIG. 11 and FIG. 12) with respect to the embodiment shown in FIG. 14. In this case, it suffices to fix the second engaged part 52 to the surface on the indoor side of the cover piece 42, with the one piece 52*a* directed to the indoor side. To illustrate this different example with FIG. 12, the third piece 71*c* of the lock engage part 71 is formed to approach the cover piece 42 in the space S and not interfere with the opening/closing body 10. The urging member 72*d* is configured to cause the lock engage part 71 to pivot in the opposite direction (indoor side: lower side in FIG. 12) of the engaging direction with respect to the second engaged part 52. When in a pulled state, the cord-like member 73 causes the lock engage part 71 to pivot in the outdoor side direction (upper side direction in FIG. 12) against the urging force of the urging member 72*d* and engage with the second engaged part 52. In a state where the cord-like member 73 is loosened, the lock engage part 71 is caused to depart from the second engaged part 52 by the urging force of the urging member 72*d* to release the engaged state.

EXPLANATION OF REFERENCE NUMERALS

1: Opening/closing device
10: Opening/closing body
20: Roller member
30: Guide rail
40: Support member
41: Support piece
42: Cover piece
51: First engaged part
52: Second engaged part
60: Close prevention device
61: Fix member
62: Movable member
62*b*, 62*b*': Brake engage part
70: Lock mechanism
71: Lock engage part
S: Space

What is claimed is:

1. A device for opening and closing comprising:

a body that performs a closing operation in an opening-closing direction and that is configured to be a partition between at least two areas;

a roller member that protrudes from the body in an extending direction of the body that is perpendicular to the opening-closing direction, the roller member being rotatably supported by the body;

a guide rail that includes a receiving surface, the receiving surface receives and contacts the roller member at a side of the roller member provided away from a center of the roller member in a body thickness direction that is perpendicular to the extending direction of the body and to the opening-closing direction, and the receiving surface is configured to guide the roller member along a guide path;

a support member that includes:

a support piece that opposes the body in the extending direction of the body and that is continuous along the opening-closing direction, the support piece having a portion that is connected to a portion of the guide rail; and a cover piece that opposes a backside of the receiving surface in the body thickness direction and that is continuous along the opening-closing direction;

a first engaged part that is fixed to the support piece and includes a protruding piece that protrudes in the body thickness direction from the backside of the receiving surface towards the cover piece, the protruding piece extending from the backside of the receiving surface; and a close prevention device that is provided integrally with the body, the close prevention device including a brake engage part that is configured to attach to and detach from the protruding piece so as to brake the closing operation of the body, wherein both the protruding piece and the brake engage part are disposed in a space at least defined by the backside of the receiving surface, the support piece, the cover piece and an end face of the body that opposes the support piece and that extends along the body thickness direction, the space being continuous along the guide path.

2. The device according to claim 1, wherein the protruding piece includes:

a projection at a portion of the protruding piece that opposes the cover piece in the body thickness direction, the projection projects in the opening-closing direction; and a receiving surface that is configured to receive the brake engage part, the receiving surface is disposed at an end of the protruding piece in the opening-closing direction, the brake engage part includes:

a contact surface that is configured to contact the receiving surface of the protruding piece; and a projection that defines an end of the brake engage part, that projects in the extending direction of the body towards the support piece, and that protrudes away from the contact surface in the opening-closing direction, the projection of the brake engage part extends beyond the receiving surface of the protruding piece in the extending direction of the body, the projection of the protruding piece is disposed closer to the cover piece in the body thickness direction than the contact surface of the brake engage part, and the contact surface of the brake engage part is configured to contact the receiving surface of the protruding piece.

3. The device according to claim 2, wherein the space, in which the protruding piece is disposed, is further defined by a pair of planes, a first plane of the pair of planes extends along the extending direction of the body from a first end of the end face of the body and along the opening-closing direction, and a second plane of the pair of planes extends along the extending direction of the body from a second end of the end face of the body and along the opening-closing direction, the first and second ends of the end face of the body are opposing terminal ends of the end face in the body thickness direction.

4. The device according to claim 3, further comprising:

a second engaged part fixed to the support piece, and a lock mechanism that is attached to the body, the lock mechanism includes a lock engage part that is configured to engage with and disengage from the second engaged part, wherein the lock mechanism engages the lock engage part and the second engaged part to lock the body so that the body does not move in at least one direction along the opening-closing direction, and the second engaged part includes a depressed part disposed in the space and the depressed part is configured to engage with and disengage from the lock engage part.

5. The device according to claim 4, wherein the first engaged part and the second engaged part are integral with each other to define sections of a common engaged part, and both of the brake engage part and the lock engage part are configured to engage with and disengage from the common engaged part.

6. The device according to claim 5, wherein the lock engage part includes:

a first piece that is arranged along the extending direction of the body and along a side face of the body;

a second piece that is connected to the first piece and is arranged along the body thickness direction and along the end face of the body; and a third piece that is connected to the second piece and extends along the extending direction of the body, and the third piece is configured to pivot along the body thickness direction thereby detaching the lock engage part from the second engaged part.

7. The device according to claim 1, wherein the guide rail further comprises a store rail part that defines an upper part of the guide rail and that extends the guide path along the body thickness direction, the store rail part stores the body upon the body being opened, a second engaged part is provided at the store rail part, and when the body is opened, the body is engaged with and locked by the second engaged part.

8. The device according to claim 1, wherein the close prevention device includes a fix member that is fixed on a side of the body, and a movable member that pivots with respect to the fix member, the movable member integrally includes the brake engage part and pivots between an engage possible position, in which engagement of the brake engage part with the first engaged part is possible, and a disengaged position, in which the brake engage part is prevented from engaging with the first engaged part and is supported by the fix member, the movable member is maintained in the disengaged position by a part, which is disposed at a distance from a center of pivot in the movable member when a tension is applied to the part by a traction member, and the movable member is configured to move to the engage possible position when the tension is not applied to the part such that the movable member and the brake engage part pivot due to a weight of the movable member.

9. The device according to claim 1, wherein the protruding piece is positioned substantially entirely between the guide rail and the cover piece.

* * * * *